US009155949B2

(12) United States Patent
Yataka

(10) Patent No.: US 9,155,949 B2
(45) Date of Patent: Oct. 13, 2015

(54) GOLF CLUB MEASURING SYSTEM AND GOLF CLUB MEASURING METHOD

(75) Inventor: Koji Yataka, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 13/559,974

(22) Filed: Jul. 27, 2012

(65) Prior Publication Data

US 2013/0035174 A1 Feb. 7, 2013

(30) Foreign Application Priority Data

Aug. 1, 2011 (JP) ..... 2011-168310

(51) Int. Cl.
*A63B 69/36* (2006.01)
*A63B 59/00* (2015.01)

(52) U.S. Cl.
CPC ..... *A63B 59/0074* (2013.01); *A63B 2220/833* (2013.01)

(58) Field of Classification Search
USPC ..... 473/131, 198, 201–202, 219, 221–226, 473/231–233, 407–409; 463/3
See application file for complete search history.

(56) References Cited

U.S. PATENT DOCUMENTS 3,792,863 A * 2/1974 Evans ..... 473/223
5,542,676 A 8/1996 Howe, Jr. et al.
5,792,000 A * 8/1998 Weber et al. ..... 473/223
6,638,175 B2 * 10/2003 Lee et al. ..... 473/223
6,648,769 B2 * 11/2003 Lee et al. ..... 473/223
7,264,555 B2 * 9/2007 Lee et al. ..... 473/223

FOREIGN PATENT DOCUMENTS

JP 06-137806 5/1994
JP 11-128430 A 5/1999
JP 2003-102886 A 4/2003
JP 2003-284802 A 10/2003
JP 2004-129687 A 4/2004
JP 2005-021329 A 1/2005
JP 2005-237677 A 9/2005
JP 2006-247023 A 9/2006

(Continued)

OTHER PUBLICATIONS

Taiwanese Office Action issued for corresponding application No. TW 101127501, dated Mar. 18, 2014 (English translation attached).

(Continued)

*Primary Examiner* — Sunit Pandya
(74) *Attorney, Agent, or Firm* — Dickstein Shapiro LLP

(57) ABSTRACT

A golf club measuring system is designed to dynamically measure physical values of a golf club shaft during its swinging motion. A sensor wiring substrate includes a flexible board (e.g. polyethylene terephthalate material), a connector, a plurality of couplers, and a plurality of wires. A plurality of sensors is connected to the sensor wiring substrate via a plurality of couplers. The sensor wiring substrate is helically wound about the golf club shaft such that the flexible board is slightly warped and closely attached to the curved surface of a golf club shaft, thus reducing air resistance occurring on the golf club shaft being swung. An external device (e.g. a strain measuring device) is connected to the connector of the sensor wiring substrate so as to receive signals representing physical values (e.g. strain values), occurring on the golf club shaft being swung, from a plurality of sensors.

20 Claims, 15 Drawing Sheets

(56) References Cited

FOREIGN PATENT DOCUMENTS

| | | | |
|---|---|---|---|
| JP | 2006-289073 | A | 10/2006 |
| JP | 2010-094264 | A | 4/2010 |
| JP | 2010-094265 | A | 4/2010 |
| JP | 2010-155074 | A | 7/2010 |
| JP | 2010-187749 | A | 9/2010 |
| KR | 1991-0007555 | | 5/1991 |
| KR | 10-0923737 | B1 | 10/2009 |
| KR | 10-2010-0061710 | A | 8/2010 |

OTHER PUBLICATIONS

Korean Notice of Allowance issued for KR 10-2012-82104, mailing date Mar. 28, 2014 (English translation attached).
Chinese Office Action for corresponding Chinese Patent Application No. 201210266757.6 issued Aug. 22, 2014.

* cited by examiner

GOLF CLUB MEASURING SYSTEM AND GOLF CLUB MEASURING METHOD

BACKGROUND OF THE INVENTION

1. Field of the Invention

The present invention relates to a golf club measuring system and a golf club measuring method, each of which is able to measure physical values such as strain and torsion occurring in golf club shafts.

The present application claims priority on Japanese Patent Application No. 2011-168310, the content of which is incorporated herein by reference.

2. Description of the Related Art

Conventionally, manufacturers and dealers of golf produces have been assessing golf clubs by use of sensors attached to golf club shafts, thus measuring physical values such as strain and torsion occurring on golf club shafts. Physical values can be measured using measuring instruments by imparting a certain load to golf clubs which are fixed in position. However, it is preferable that physical values be measured with golf clubs actually being swung in order to obtain good assessment on impacts on players' swinging motions of golf club shafts or properties of golf balls being struck with golf club heads.

Various methods for assessment, analysis, and optimum selection of golf clubs have been disclosed in patent literatures (PLT) 1 to 11. PLT 1 disclosed an assessment method of dynamic behavior of a golf club shaft, wherein strain gauges are attached to two points arbitrarily selected on a golf club shaft so as to measure strain occurring between two points of a golf club shaft during the swinging motion of a golf club shaft. PLT 2 disclosed a shaft selection method for a golf club optimum to each golfer, wherein it teaches a method for selecting a golf club shaft demonstrating the ideal deflection/bending behavior and the rigidity distribution optimum to each golfer. PLT 3 disclosed a selection system of an optimum golf club shaft, wherein it teaches a method for selecting a golf club shaft demonstrating the optimum head-moving speed based on the analysis result regarding the deformation behavior of each golf club shaft. PLT 4 disclosed a golf club selection method that selects a golf club based on the measurement result of gyro-sensor units measuring the movement of hands or other body parts of each golfer swinging his/her golf club. PLT 5 disclosed a golf club shaft selection method that selects a golf club shaft whose property matches each golfer's physical feature and profile considering the head-moving speed, the swing tempo, and the ideal trajectory of a golf ball. PLT 6 disclosed a golf club information providing system that manages the relationship between the registered clients and the specifications of golf clubs matching with the clients' swinging motions, thus improving the efficiency in selecting golf clubs for clients. PLT 7 disclosed a golf club shaft selection method that selects a golf club shaft based on the measurement result of the head-moving speed and the swing tempo for each golfer with reference to the predetermined chart describing weights and behaviors of golf club shafts. PLT 8 disclosed a golfer classification method that classifies golfers based on the measurement result of physical values representing golfers' features determined by golf swing computation simulating golf club models based on three-dimensional time-series data relating to motions of golfers' hands holding grips of golf clubs, thus selecting optimum golf clubs for golfers. PLT 9 disclosed a golfer classification method, which teaches a modified technology of PLT 8 with additionally implementing head-moving speed computation. PLT 10 disclosed a golf club selection method that selects an optimum combination of a head and a shaft constituting a golf club based on the measurement result of the behavior of each golf club, which can be physically separated into a head and a shaft, before and after the striking of a golf ball with a golf club. PLT 11 disclosed a golf club shaft selection system that offers a recommended golf club shaft considering its bending point which is presumed based on the measured values of strain gauges attached to each golf club shaft.

Generally speaking, a few grams of weight attached to a head may cause a significant impact on the behavior of a golf club shaft being swung. In the foregoing measuring method, strain gauges attached to a golf club shaft are electrically connected to a strain measuring device via a wiring cable, whereby a golf club shaft may undergo variable behavior due to the weight of a wiring cable. Additionally, a golf club shaft may undergo variable behavior due to physical force applied to a wiring cable which moves in the air against the air resistance together with a golf club being swung. Therefore, the foregoing measurement method using a wiring cable may measure uncertain physical values on a golf club shaft undergoing variable behavior.

CITATION LIST

Patent Literature

PLT 1: Japanese Patent Application Publication No. 2003-102886

PLT 2: Japanese Patent Application Publication No. 2003-284802

PLT 3: Japanese Patent Application Publication No. 2004-129687

PLT 4: Japanese Patent Application Publication No. 2005-21329

PLT 5: Japanese Patent Application Publication No. 2005-237677

PLT 6: Japanese Patent Application Publication No. 2006-247023

PLT 7: Japanese Patent Application Publication No. 2006-289073

PLT 8: Japanese Patent Application Publication No. 2010-94264

PLT 9: Japanese Patent Application Publication No. 2010-94265

PLT 10: Japanese Patent Application Publication No. 2010-155074

PLT 11: Japanese Patent Application Publication No. 2010-187749

SUMMARY OF THE INVENTION

It is an object of the present invention to provide a golf club measuring system and a golf club measuring method, each of which is able to reliably measure physical values, relating to the behavior of each golf club shaft being swung, by use of sensors attached to each golf club shaft and transmit them to an external device for assessment and analysis of each golf club shaft.

It is another object of the present invention to provide a golf club measuring system and a golf club measuring method, each of which is able to prevent uncertain variations of physical values measured on each golf club shaft irrespective of a wiring cable connecting sensors attached to each golf club shaft.

A first aspect of the present invention is related to a golf club measuring system for dynamically measuring physical values of a golf club shaft being swung. The golf club measuring system adopts a sensor wiring substrate in connection with a plurality of sensors attached to a golf club shaft at the predetermined positions. The sensor wiring substrate includes a flexible board which is attached to the golf club shaft, a plurality of couplers which are connected to the sensors, and a plurality of wires which are juxtaposed to each other and connected to the sensors via the couplers. The flexible board is slightly warped and closely attached to the curved surface of a golf club shaft.

A second aspect of the present invention is related to a golf club measuring method for dynamically measuring physical values of a golf club shaft being swung. The golf club measuring method adopts a sensor wiring substrate in connection with a plurality of sensors which are attached to a golf club shaft at the predetermined positions. The sensor wiring substrate including a flexible board, a plurality of couplers and a plurality of wires is attached to a golf club shaft such that the flexible board is slightly warped and closely attached to the curved surface of the golf club shaft. The golf club measuring method includes the steps of: attaching the sensor wiring substrate to a golf club shaft; connecting a plurality of sensors to a plurality of couplers of the sensor wiring substrate; connecting an external device to a base portion of the sensor wiring substrate; and measuring physical values occurring on the golf club shaft being swung with the external device receiving signals representing physical values from the sensors via the couplers and the wires.

A third aspect of the present invention is related to a golf club equipped with a plurality of sensors via a sensor wiring substrate.

Since the present invention adopts a brand-new design of a sensor wiring substrate which can be helically wound about a golf club shaft, which can be flexibly warped along the curved surface of a golf club shaft, and which can be easily connected to a plurality of sensors with a plurality of couplers, it is possible to measure physical values (e.g. strain values) with the sensors and transmit them to an external device (e.g. a strain measuring device) for assessment of the dynamic behavior of each golf club shaft being swung. Compared with the conventional cable wiring which connects sensors via wires or cables arranged externally of a golf club shaft, it is possible to reduce air resistance occurring on a golf club shaft being swung because all the components are closely combined and tightly attached to a golf club shaft so as not to obstruct a swinging motion with wires or the like.

BRIEF DESCRIPTION OF THE DRAWINGS

These and other objects, aspects, and embodiments of the present invention will be described in more detail with reference to the following drawings.

DESCRIPTION OF THE PREFERRED EMBODIMENTS

The present invention will be described in further detail by way of examples with reference to the accompanying drawings.

1. Preferred Embodiment

Figure 1:
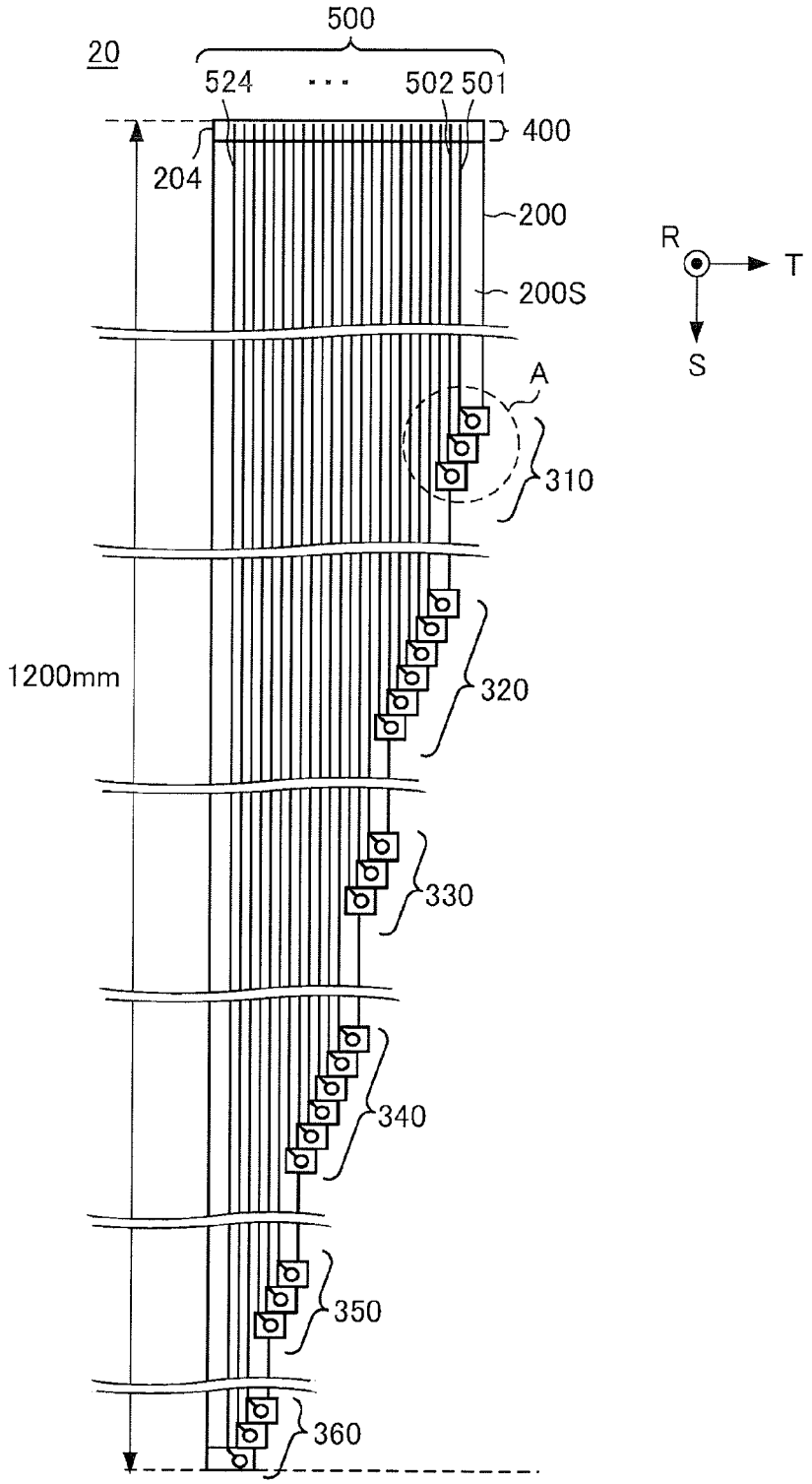
FIG. 1 is a schematic illustration of a sensor wiring substrate which is detachably attached to a golf club shaft.

FIG. 1 is a schematic illustration of a sensor wiring substrate 20 which is detachably attached to a golf club shaft. The sensor wiring substrate 20 includes a flexible board 200, a plurality of couplers 300 (i.e. couplers 310, 320, 330, 340, 350, and 360), and a connector 400, twenty-four wires 500 (i.e. wires 501 to 524).

The flexible board 200 composed of polyethylene terephthalate material can be warped or bent in various shapes. In particular, the flexible board 200 normally having a plane board shape can be easily bent in a direction R perpendicular to a surface 200S rather than other directions. The wires 500 are extended and laid in the flexible board 200; in other words, the flexible board 200 extends in an extending direction S of each wire 500.

The wires 500 are metal wires corresponding to copper foils which are print-wired in the flexible board 200 and able to transmit electric signals therethrough. The wires 500 are embedded in the flexible board 200 such that they are covered with the flexible board 200. The polyethylene terephthalate material constituting the flexible board 200 has property of transmitting visible light therethrough. Additionally, the flexible board 200 is formed using polyethylene terephthalate material having a specific color different from the copper color; this allows users to visually recognize the presence of the wires 500 through the flexible board 200. In FIG. 1 and its related figures, the wires 500 are drawn using solid lines. The wires 500 are juxtaposed in a direction perpendicular to the extending direction S with equal spacing therebetween. This direction corresponds to the width of the flexible board 200 including the wires 500; hereinafter, this direction will be referred to as a width direction T. The width direction T crosses the extending direction S. The wires 500 are extended from the common base end to their distal ends in the extending direction S of the flexible board 200.

The connector 400 is attached to the common base of the flexible board 200 in the extending direction S. The copper foils of metal wires, connected to the wires 500, are exposed on a connector board 204 of the connector 400 connected to the flexible board 200. The connector board 204 is integrally unified with the flexible board 200. In the flexible board 200 composed of polyethylene terephthalate material, a part of the flexible board 200 connected to the connector 400 refers to the connector board 204 whilst the wires 500 are laid in the remaining part of the flexible board 200. The connector 400 is interposed between the wires 500 and an external device (not shown); hence, the connector 400 is arranged to electrically connect the wires 500 and an external device. In other words, the connector 400 are electrically connected to one ends of the wires 500 which are opposite to the distal ends of the wires 500 coupled with the couplers 300.

Figure 2:
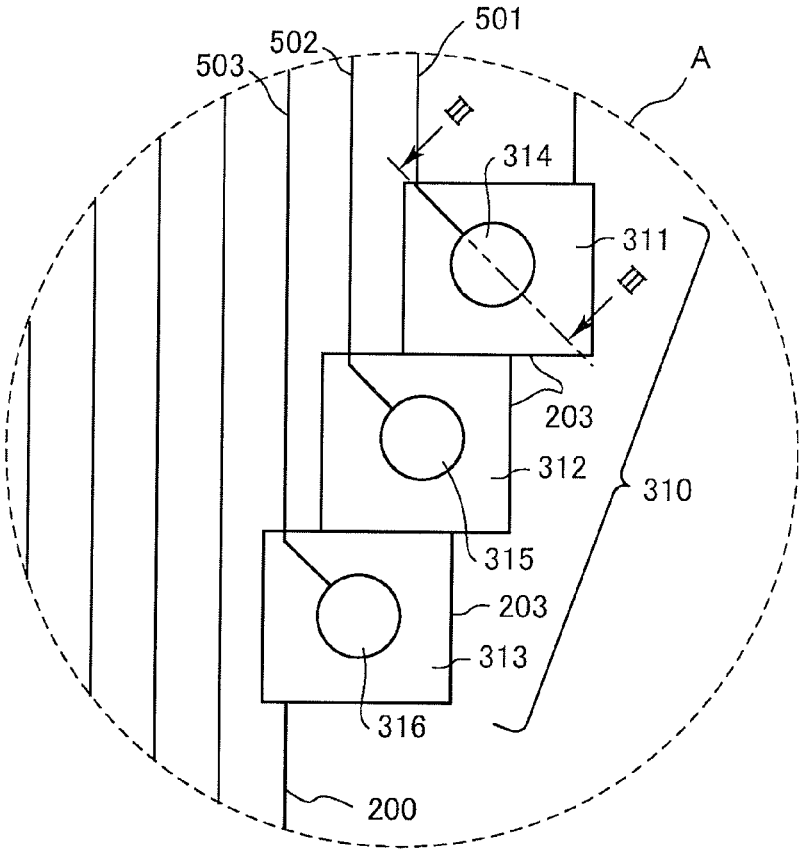
FIG. 2 is an enlarged view of a joint encompassed in a circular area A shown in FIG. 1.

The couplers 300 are attached to the distal ends of the flexible board 200 which are positioned opposite to the connector 400 in the extending direction S. FIG. 2 is an enlarged view magnifying the coupler 310 encompassed in a circular area A shown in FIG. 1. The coupler 310 includes three couplers 311, 312, 313 attached to a coupling board 203. The couplers 311, 312, 313 include metal terminals 314, 315, 316 (i.e. circular copper foils) which are connected to the wires 501, 502, 503. Similar to the connector board 204, the coupling board 203 is integrally unified with the flexible board 200. In other words, the coupling board 203 corresponds to a part of the flexible board 200 (composed of polyethylene terephthalate material) mounting the coupler 300.

Figure 3:
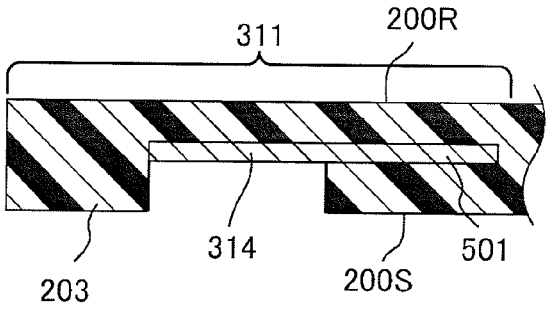
FIG. 3 is a cross-sectional view taken along line in FIG. 2.

The specifics regarding the coupler 311 and the wire 501 shown in FIG. 2 will be described with reference to FIG. 3. FIG. 3 is a cross-sectional view taken along a line III-III vertically cutting the coupler 311 and the wire 501 in FIG. 2. The wire 501 is covered with the flexible board 200 such that the terminal end thereof is connected to the metal terminal 314. The metal terminal 314 is exposed on the surface 200S but not exposed on a rear surface 200R of the flexible board 200.

The sensor wiring substrate 20 is a flexible substrate with a printed pattern of the wires 500 which connect between the couplers 300 and the connector 400 on the flexible board 200.

Next, the operation of the sensor wiring substrate 20 attached to a golf club will be described with reference to FIGS. 4 to 6.

Figure 4:
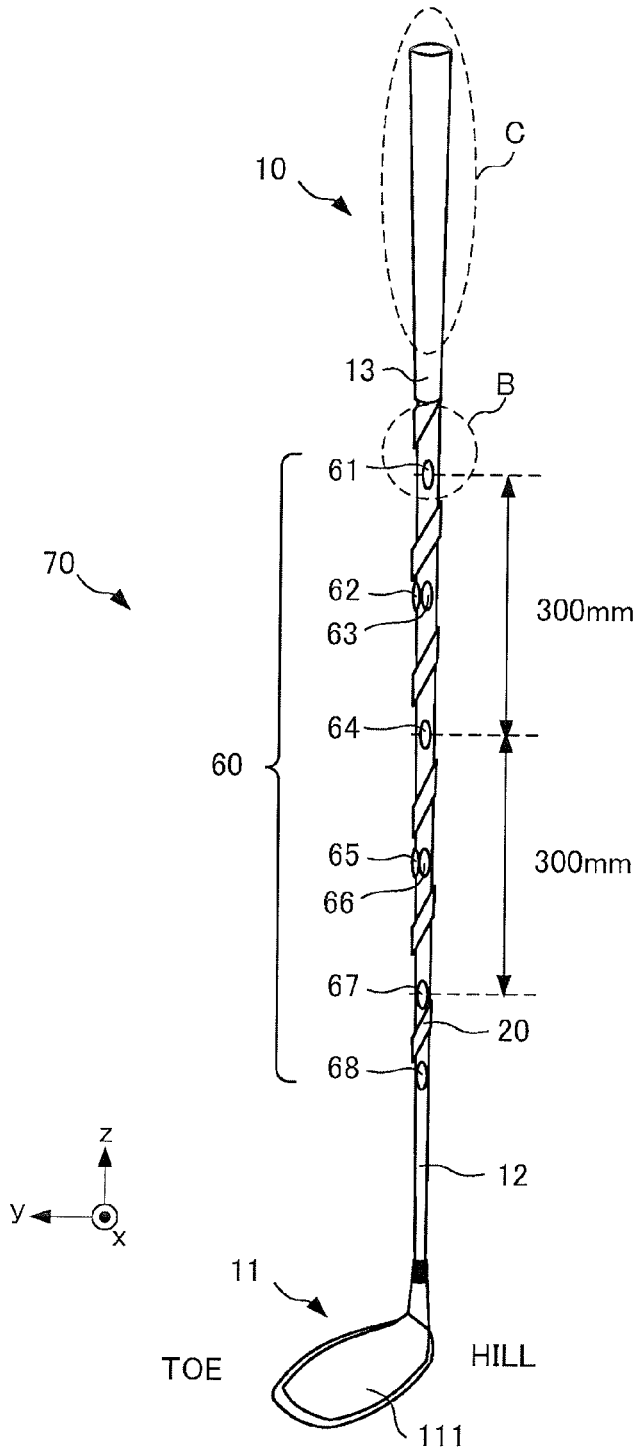
FIG. 4 is a perspective view of a golf club equipped with the sensor wiring substrate.

FIG. 4 is a perspective view of a golf club 10 equipped with the sensor wiring substrate 20. The golf club 10 includes a shaft 12 with a head 11 and a grip 13 at opposite ends. A golfer holds (or grips) the grip 13 of the golf club 10 and then swings the golf club 10 so as to hit a golf ball (not shown) with a face 111 of the head 11. The shaft 12 is found using a hollow member having a tapered shape whose width decreases towards the head 11. When a golfer swings the golf club 10, the shaft 12 is being warped or partially bent due to the weight of the head 11 and the weight of the shaft 12. The warped manner, i.e. the degree and position of warping, may vary depending on the strength and property of the shaft 12 or the swinging motion. For the purpose of assessment of warping, the present embodiment measures strains at various positions of the shaft 12. The measurement is performed using a golf club measuring system 70 shown in FIG. 4. The golf club measuring system 70 includes the sensor wiring substrate 20 equipped with a plurality of sensors 60 (i.e. sensors 61, 62, 63, 64, 65, 66, 67, and 68). The shaft 12 is equipped with the sensors 60 at measuring positions for measuring strains. The sensors 60 are fixed to the predetermined positions by use of adhesive agents or adhesive tapes (not shown).

Next, the positions for mounting the sensors 60 will be described in detail. FIG. 4 refers to three-dimensional coordinates in which a z-axis indicates a direction from the head 11 to the grip 13 along the shaft 12; a y-axis, perpendicular to the z-axis, indicates a direction from the heel to the toe of the head 11; and an x-axis, perpendicular to the y-axis and the z-axis, indicates a direction in which the face of the head 11 is directed. When a golfer (or a user) swings the golf club 10, the bending/warping of the shaft 12 may occur essentially in the x-axis direction and the y-axis direction. To evaluate the bending/warping of the shaft 12 in these directions, the sensors 61, 63, 64, 66, 67, and 68 are attached to the shaft 12 in the x-axis direction whilst the sensors 62 and 65 are attached to the shaft 12 in the y-axis direction. The sensor 64 is fixed below the center of gravity of the golf club 10 and positioned close to the grip 13. The sensor 61 is fixed to a higher position, which is close to the grip 13 and above the sensor 64 by 300 mm, while the sensor 67 is fixed to a lower position close to the head 11 and below the sensor 64 by 300 mm. The sensors 62, 63 are fixed to a midpoint between the sensors 61 and 64, while the sensors 65, 66 are fixed to a midpoint between the sensors 64 and 67. Additionally, the sensor 68 is fixed to the lowest position which is below the sensor 67 and closer to the head 11 than the sensor 67. Using the sensors 60 attached to the shaft 12 at their positions, it is possible to measure strain values at six points in the x-axis direction, and it is possible to measure strain values at two points in the y-axis direction.

Next, the fixing method of the sensor wiring substrate 20 with the shaft 12 of the golf club 10 will be described in detail. The sensor wiring substrate 20 is attached to the golf club 10 such that the intermediate portion of the flexible board 200 sandwiched between the connector 400 and the couplers 300 is wound about the shaft 12 in a helical manner. In the wound state of the sensor wiring substrate 20, the flexible board 200 is attached to the shaft 12 such that the backside 200R is positioned to directly face the exterior of the shaft 12 and is warped around the exterior of the shaft 12. When the sensor wiring substrate 20 is firmly attached to the shaft 12, the extending direction S may form a certain angle against the z-axis direction. Additionally, the sensor wiring substrate 20 is wound about the shaft 12 without overlapping with the sensors 60. A mounting direction of the sensor wiring substrate 20 (in other words, an angle formed between the extending direction S and the z-axis direction) is determined such that the sensor wiring substrate 20 is laid on the path around the shaft 12 without overlapping with the sensors 60. The connector 400 of the flexible board 200 of the sensor wiring substrate 20 is fixed and tightly held between the grip 13 and the shaft 12, whilst the terminal end of the flexible board 200 opposite to the connector 400 is fixed to the shaft 12 at the predetermined position, close the sensor 68, by use of the adhesive agent or the adhesive tape. As described above, the connector 400 and the terminal end of the flexible board 200 of the sensor wiring substrate 20 are solely fixed to the shaft 12, whilst the intermediate portion of the flexible board 200 is not fixed to the shaft 12.

When a golfer swings the golf club 10, the shaft 12 is partially warped so that a distance between two points on the exterior of the shaft 12 will be varied. When the sensor wiring substrate 20 is entirely fixed to the exterior of the shaft 12 by use of the adhesive agent, warping force is applied to the fixed portion of the sensor wiring substrate 20 due to the warping of the shaft 12, whereby the adhesive agent will be partially peeled off and therefore the sensor wiring substrate 20 will be damaged. The sensor wiring substrate 20 of the present embodiment is designed such that the unfixed portion thereof can be entirely deformed due to the warping force of the shaft 12, whereby the contact portion of the sensor wiring substrate 20, which is brought into contact with the exterior of the shaft 12, is shifted in position in the z-axis direction due to the warping force of the shaft 12; hence, it is possible to reliably prevent the destruction of the sensor wiring substrate 20. Compared to the former case in which the sensor wiring substrate 20 is entirely fixed to the exterior of the shaft 12, it is possible to prevent the sensor wiring substrate 20 from being damaged due to the warping of the shaft 12.

Since the sensor wiring substrate 20 is wound about the shaft 12, it is possible to tightly fix the sensor wiring substrate 20 to the shaft 12 due to the component of force exerted in the extending direction S derived from an external force applied to a certain position of the sensor wiring substrate 20 rather than the sensor wiring substrate 20 not undergoing the component of force. This increases frictional force applied between the sensor wiring substrate 20 and the shaft 12; therefore, it is possible to prevent the sensor wiring substrate 20 from being unexpectedly shifted in position, and it is possible to suppress force applied to the fixed positions of the sensor wiring substrate 20 at the opposite ends in the extending direction S. A swinging motion may cause the sensor wiring substrate 20 to be internally biased toward its terminal portion due to the centrifugal force or gravitation. To prevent such an internal bias of the sensor wiring substrate 20, it is necessary to additionally fix the intermediate portion of the sensor wiring substrate 20 to the intermediate portion of the shaft 12. The intermediate portion of the sensor wiring substrate 20 can be fixed using adhesive tapes applied to the couplers 300. The fixing method should be selected not to affect the warping of the shaft 12. The intermediate fixing positions of the sensor wiring substrate 20 are not necessarily limited to the couplers 300 but can be set to arbitrary positions along the shaft 12.

The sensor wiring substrate 20 is connected to the sensors 60 via the couplers 300. An example of connection between the sensor 61 and the coupler 310 is shown in a circular area B in FIG. 4.

Figure 5:
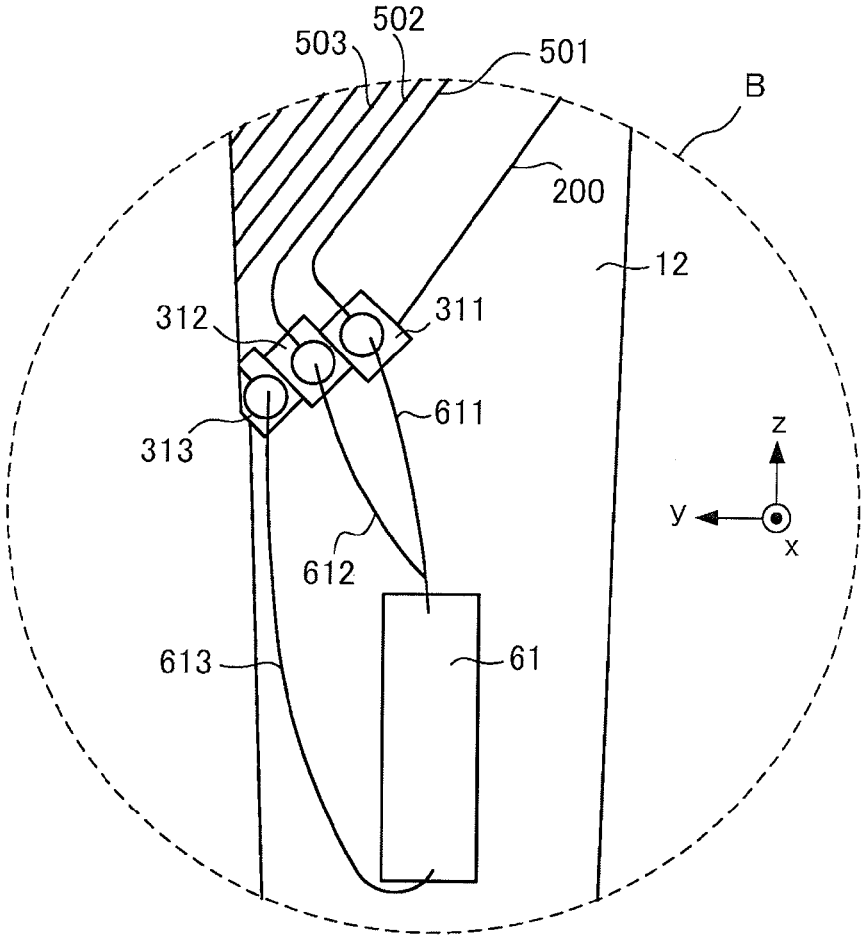
FIG. 5 is an enlarged view of a sensor connected to a joint encompassed in a circular area B shown in FIG. 4.
Figure 6:
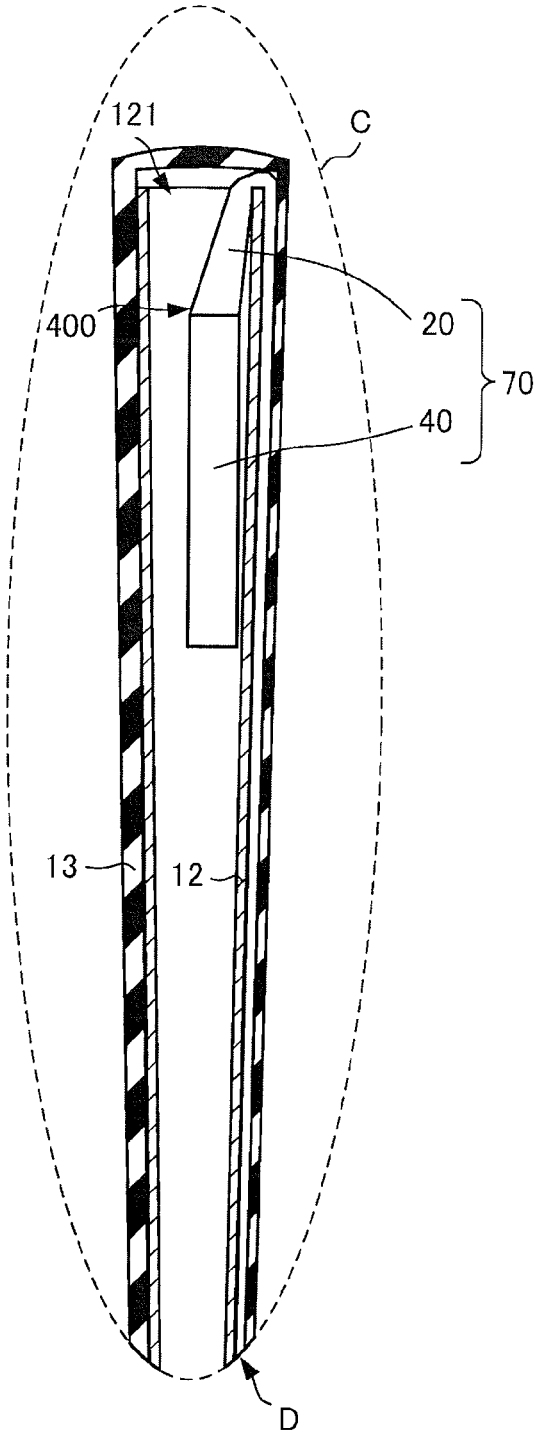
FIG. 6 is a cross-sectional view showing the internal structure of a shaft and a grip of the golf club including a connector of the sensor wiring substrate 20 encompassed in a circular area C shown in FIG. 4.

FIG. 5 is an enlarged view magnifying the circular area B including the sensor 61 in FIG. 4. The coupler 310 includes the three couplers 311, 312, 313 electrically connected to the wires 501, 502, 503. The sensor 61 is electrically connected to the couplers 311, 312, 313 via connecting wires 610 (i.e. lines 611, 612, 613). That is, the sensor 61 is a three-wired strain gauge which is able to transmit electric signals via three paths formed using the connecting wires 610, the couplers 311-313, and the wires 500. The couplers 311-313 are interposed between the wires 500 and the sensor 61 so as to electrically connect them together. In other words, the couplers 311-313 are electrically connected to the wires 500 and the sensor 61. The opposite ends of each connecting wire 610 are soldered to each coupler of the coupler 310 and the sensor 61 but are not fixed to the shaft 12. Additionally, the connecting wires 610 are deformable. Even when the shaft 12 is warped so that a distance between the coupler 310 and the sensor 61 are varied, it is possible to prevent solder from being peeled off and to prevent the connecting wires 610 from being damaged due to the deformability of the connecting wires 610. There still remains a risk that the connecting wires 610 may be damaged when one connecting wire 610 comes in contact with another connecting wire 610. This risk can be alleviated when the intermediate portion of the sensor wiring substrate 20 is fixed to the shaft 12 such that the coupler 310, the connecting wires 610, and the sensor 61 are collectively covered with a covering film (not shown). As a covering film, it is possible to employ an adhesive tape or heat-shrinkable tubing, by which the above components are entirely covered and fixed to the shaft 12. Additionally, it is possible to improve the connecting ability of the connecting wires 610 by use of a covering film. Even when the coupler 310 directly joints to the sensor 61 without using the connecting wires 610, a covering film may strengthen the joint between the coupler 310 and the sensor 61 so as to firmly fix the intermediate portion of the sensor wiring substrate 20 to the shaft The structure relating to the connector 400 of the sensor wiring substrate 20 is shown in a circular area C in FIG. 4. FIG. 6 is cross-sectional view showing the internal structure of the shaft 12 and the grip 13 including the connector 400 encompassed in the circular area C shown in FIG. 4. An opening end 121 is formed at the upper end of the shaft 12 furnished with the grip 13. The grip 13, composed of rubber material, is attached to the upper portion of the shaft 12 so as to cover the opening end 121. The grip 13 is formed in a shape allowing a golfer to grip it. The grip 13 is attached to the upper portion of the shaft 12 whose exterior surface is partially shaved off so that a gap D is formed between the interior of the grip 13 and the shave exterior of the shaft 12. Alternatively, the grip 13 is produced in a predetermined shape which allows the gap D to be formed between the interior of the grip 13 and the exterior of the shaft 12 when the grip 13 is attached to the upper portion of the shaft 12. Thus, the grip 13 is tightly brought into close contact with the shaft 12 except for the gap D. In other words, the grip 13 does not come in contact with the shaft via the gap D, through which the sensor wiring substrate 20 is attached to the shaft 12 and elongated to reach the opening end 121. The upper portion of the sensor wiring substrate 20 is introduced inside the opening end 121 of the shaft and electrically connected to a strain measuring device 40 via the connector 400. The strain measuring device 40 is an external device which is electrically connected to the wires 500 via the connector 400. In short, the golf club measuring system 70 includes the strain measuring device 40 in addition to the sensor wiring substrate 20 and the sensors 60.

The strain measuring device 40 applies electric currents to the sensors 60 via the wires 500, the couplers 300, and the connecting wires 610 so as to measure strain values equivalent to variations of measured resistances. Variations of measured resistances represent strain values measured with the sensors 60. Electric currents representing measured resistances are transmitted to the strain measuring device 40 via the couplers 300 and the wires 500 as signals representing the measuring results of the sensors 60. In short, the sensors 60 send signals to the strain measuring device 40 via the sensor wiring substrate 20. The strain measuring device 40 includes a memory storing measured values. That is, the strain measuring device 40 measures strain values, which are measured at the fixed positions of the eight sensors 60, so as to temporarily store them in the memory. Additionally, the strain measuring device 40 starts its measuring operation in response to an instruction wirelessly transmitted by an external device (not shown). Upon receiving an instruction, the strain measuring device 40 starts to measure and store strain values at various points of the shaft 12 while a golfer swings the golf club 10. Additionally, the strain measuring device 40 implements a wireless communication function which is able to transmit measured values an external device implementing a counterpart wireless communication function.

As described above, it is possible to measure strain values from the shaft 12 during a golfer's swinging motion of the golf club 10 which is equipped with the sensor wiring substrate 20, the sensors 60, and the strain measuring device 40. These parts of the golf club measuring system 70 can be attached to each golf club which is finished in production by temporarily removing and then reattaching its grip with the shaft of each golf club. In other words, the golf club measuring system 70 can be detachably attached to any types of golf clubs owned by golfers. Additionally, it is possible to fix the connector 400 of the sensor wiring substrate 20 to the golf club 10 without using adhesive materials such that the sensor wiring substrate 20 is fixed inside the gap D between the grip 13 and the shaft 12; this fixing method reduces the additional weight necessary to fix the golf club measuring system 70 to the golf club 10 rather than another fixing method using adhesive materials. The top portion of the sensor wiring substrate 20 above the upper portion of the sensor wiring substrate 20 (close to the connector 400) sandwiched between the grip 13 and the shaft 12 is surrounded and covered with the grip 13 so as not to cause air resistance during a swinging motion of the golf club 10.

The sensor wiring substrate 20 includes the flexible board 200 which is bent or warped along the exterior shape of the shaft 12. Compared to the cable wiring using cables wired to sensors, the sensor wiring substrate 20 is able to suppress air resistance which may occur during a swinging motion of the golf club 10. In other words, the sensor wiring substrate 20 is advantageous to the cable wiring in that the sensor wiring substrate 20 is able to suppress unnatural variation occurring on the behavior of the shaft 12 being swung compared to the golf club 10 not equipped with any wires and additional components such as the sensor wiring substrate 20 and cable wirings.

The sensor wiring substrate 20 can be produced with a small weight of two grams or so by use of the flexible board 200. Compared to the cable wiring using twenty-four wires, the sensor wiring substrate 20 using the twenty-four wires 500 can be reduced in weight. Compared to the cable wiring, the sensor wiring substrate 20 is able to suppress variation of weight balance occurring on the shaft 12 during a swinging motion of the golf club 10. This makes it possible to measure strain values in a swing motion of the golf club 10, equipped with the sensor wiring substrate 20, approximate to the natural swing motion of the golf club 10 not equipped with any wires and components. Compared to the cable wiring, the sensor wiring substrate 20 is able to suppress the weight thereof from affecting the behavior of the shaft 12 during a swinging motion of the golf club 10.

Allowing for some influence of the additional weight affecting the behavior of the shaft 12 during a swinging motion of the golf club 10, the sensor wiring substrate 20 is able to install a larger number of wires 500 than the number of wires which can be included in the cable wiring. Compared to the cable wiring, the sensor wiring substrate 20 is able to attach a large number of wires 500 so as to measure a large number of strain values at various points of the shaft 12 during a swinging motion of the golf club 10. Thus, compared to the cable wiring, the sensor wiring substrate 20 may offer a high accuracy of assessment on the bending/warping of the shaft 12 during a swinging motion of the golf club 10.

2. Variations

The present invention is not necessarily limited to the foregoing embodiment, which can be modified in various ways. Variations of sensor wiring substrates will be described below. These variations can be appropriately combined together as necessary.

(1) First Variation

The present invention is directed to sensor wiring substrate ascribed to various parameters, such as the positions of couplers, the number of couplers, the positions of wires, and the number of wires, which are not necessarily limited to those adopted in the foregoing embodiment.

Figure 7:
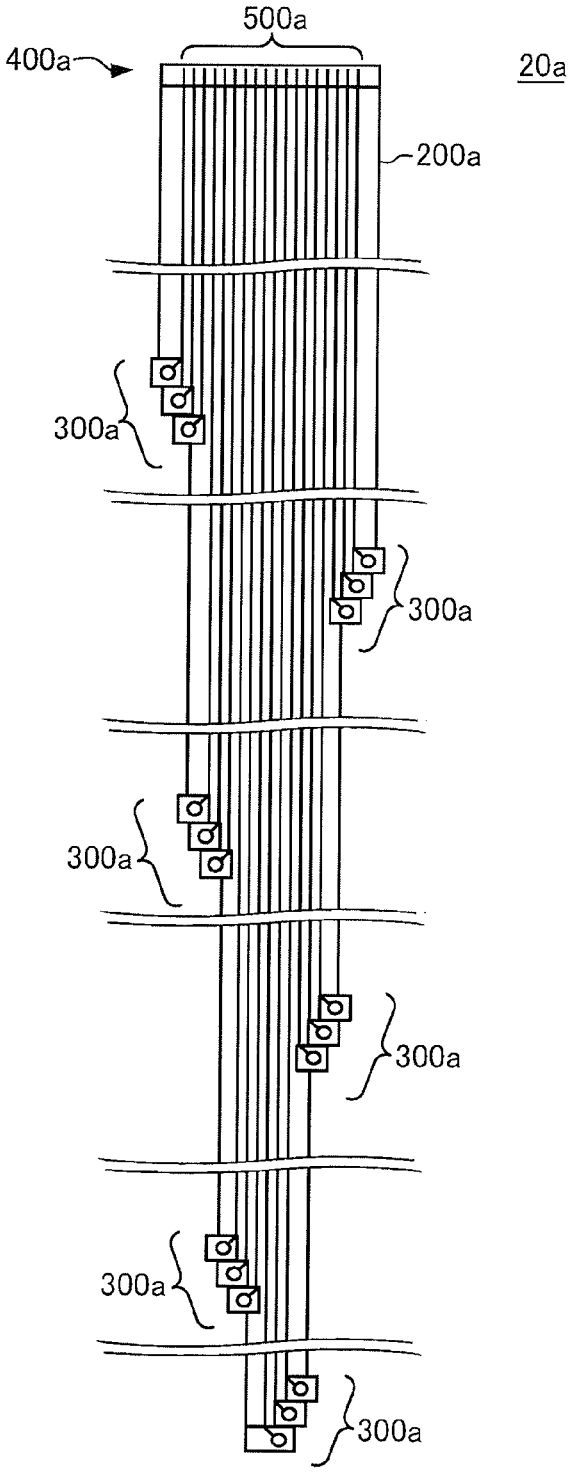
FIG. 7 is a schematic illustration of a sensor wiring substrate according to a first variation, equipped with six sets of couplers separately fixed to the left and right sides.

FIG. 7 is a schematic illustration of a sensor wiring substrate 20*a* according to a first variation. The sensor wiring substrate 20*a* includes a flexible board 200*a* equipped with sixteen wires 500*a* and eighteen couplers 300*a* as well as a connector 400*a*. The eighteen couplers 300*a* are subdivided into six sets of three couplers 300*a* which are attached to six positions of the main portion of the flexible board 200*a* below the connector 400*a* on which the wires 500*a* are exposed. Specifically, three sets of three couplers 300*a* are arranged in the left side of the flexible board 200*a* while the other three sets of three couplers 300*a* are arranged in the right side of the flexible board 200*a* in the width direction of the sensor wiring substrate 20*a*. The sensor wiring substrate 20*a* allows for six sensors (e.g. the foregoing sensors 60*a* each configured of a three-wired strain gauge) which are attached to the six positions. When the sensor wiring substrate 20*a* is helically wound about the shaft 12 of the golf club 10, the sensor wiring substrate 20*a* may be separated into the upper portion close to the grip 13 and the lower portion close to the head 11. In this case, the sensors 60 can be attached to the six sets of couplers 300*a* without overlapping their connecting wires (which connect between the sensors 60 and the couplers 300*a*). It is preferable that the sensors 60 be attached to the sensor wiring substrate 20*a* without overlapping their connecting wires. That is, the sensor wiring substrate 20*a* is produced based on a design plan regarding the positions of sensors and the number of sensors, attached to the shaft 12 of the golf club 10, thus specifically determining the foregoing parameters such as the positions of couplers 300*a*, the number of couplers 300*a*, the positions of wires 500*a*, and the number of wires 500*a*.

(2) Second Variation

The sensors 60 are configured to measure strain values at various positions of the shaft 12 of the golf club 10 being swung; but this is not a restriction. It is possible to employ other types of sensors which are able to measure other physical values such as the torsion of the shaft 12 or the acceleration of the shaft 12 at their fixed positions. The torsion and acceleration are physical values which may be varied while the golf club 10 is being swung. In either case, the strain measuring device 40 should be changed with another type of measuring device which is able to measure physical values detected with sensors, thus assessing the behavior of the shaft 12 of the golf club 10 being swung.

(3) Third Variation

Both the foregoing embodiment and the first variation adopt a plurality of couplers and a plurality of wires; but it is possible to adopt a single coupler and a single wire for use in a sensor wiring substrate. For example, the third variation may employ a one-wired sensor which measures a physical value of the shaft 12 at one position. In this case, a single sensor should be connected to a measuring device by means of a sensor wiring substrate including a flexible board with a single coupler and a single wire.

(4) Fourth Variation

The shape of a flexible board applicable to a sensor wiring substrate is not necessarily limited to the shapes of the flexible boards 200 and 200*a*. In the foregoing embodiment, the flexible board 200 is formed in a shape embracing a plurality of imaginary lines (or extension lines) connecting between the couplers 300 and the connector 400 on the surface 200S with the shortest distances therebetween; but this is not a restriction. It is possible to employ a flexible board deliberately precluding a part of areas on the extension lines connecting between the couplers 300 and the connector 400. In other words, it is possible to employ a flexible board bypassing a certain area in the width direction. Examples of flexible boards with bypass parts for bypassing a certain area will be described with reference to FIGS. 8A and 8B.

Figure 8A:
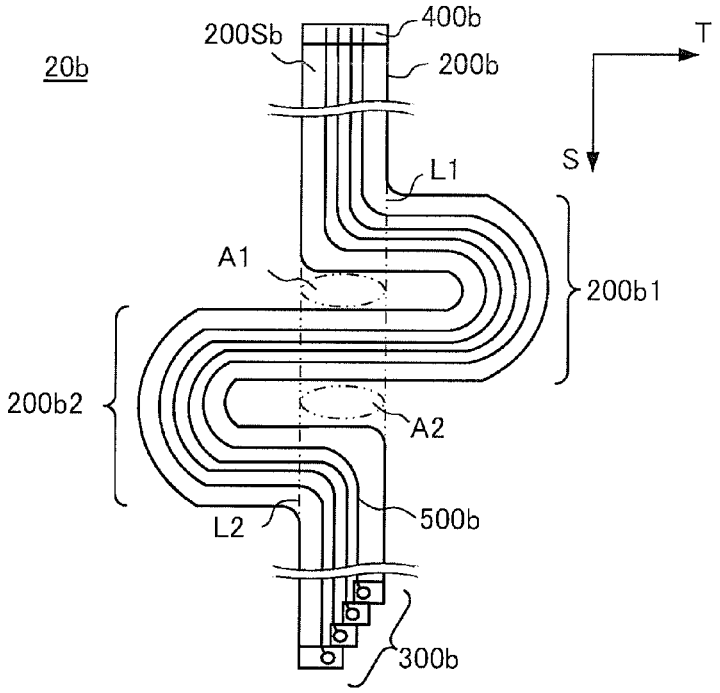
FIG. 8A is an enlarged view magnifying a sensor wiring substrate including a flexible board with bypass parts according to a fourth variation.

FIG. 8A shows a sensor wiring substrate 20*b* including a flexible board 200*b* which is partially meandered to form bypass parts 200*b*1, 200*b*2. The sensor wiring substrate 20*b* further includes a plurality of couplers 300*b*, a plurality of wires 500*b*, and a connector 400*b*. In the flexible board 200*b* of the sensor wiring substrate 20*b*, the bypass part 200*b*1 bypasses an area A1 in the width direction T, whilst the bypass part 200*b*2 bypasses an area A2 in the width direction T. Both the areas A1 and A2 are formed along a part of the extension lines connecting between the couplers 300*b* and the connector 400*b* on a surface 200Sb with the shortest distances therebetween, wherein the areas A1, A2 are interposed between extension lines L1, L2 corresponding to the opposite sides of the sensor wiring substrate 20*b* in the width direction T. Additionally, the wires 500*b* are wired to bypass the areas A1, A2 in the width direction T in conformity with the shape of the flexible board 200*b*.

Figure 8B:
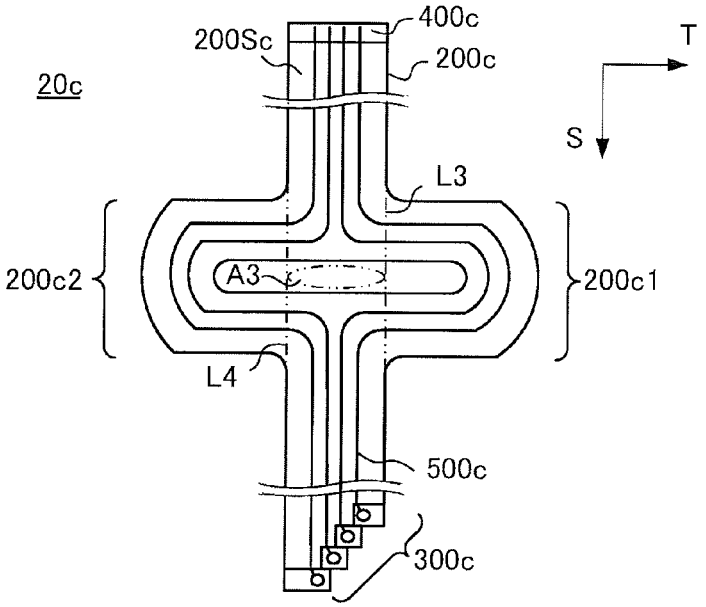
FIG. 8B is an enlarged view magnifying a sensor wiring substrate including a flexible board with bypass parts according to the fourth variation.

FIG. 8B shows a sensor wiring substrate 20*c* including a flexible board 200*c* which is partially expanded in the width direction to form bypass parts 200*c*1, 200*c*2. The sensor wiring substrate 20*c* further includes a plurality of couplers 300*c*, a plurality of wires 500*c*, and a connector 400*c*. In the flexible board 200*c* of the sensor wiring substrate 20*c*, the bypass parts 200*c*1, 200*c*2 are meandered in different directions so as to bypass an area A3 in the width direction T. The area A3 is formed along a part of the extension lines connecting between the couplers 300*c* and the connector 400*c* on a surface 200Sc with the shortest distances therebetween, wherein the area A3 is interposed between extension lines L3, L4 corresponding to the opposite sides of the sensor wiring substrate 20*c* in the width direction T. The flexible board 200*c* is partially separated into two branches with the bypass parts 200*c*1, 200*c*2 in order to bypass the area A3, but these branches are unified together after bypassing the area A3. Correspondingly, the wires 500*c* are partially branched into the bypass parts 200*c*1, 200*c*2 in order to bypass the area A3.

Each of the sensor wiring substrates may undergo a tensile force in the extension direction S while a golf club is being swung. The sensor wiring substrates 20*b* and 20*c* are advantageous in that their lengths can be elongated in the extending direction S because the bypass parts 200*b*1, 200*b*2 and the bypass parts 200*c*1, 200*c*2 are deformable in response to extensile force applied thereto while a golf club is being swung. Compared with other types of sensor wiring substrates not including bypass parts, it is possible to prevent the sensor wiring substrates 20*b* and 20*c* from being damaged due to tensile force exerted in the extending direction S. In this connection, shapes of bypass parts applicable to sensor wiring substrates are not necessarily limited to the shapes of the bypass parts 200*b*1, 200*b*2, 200*c*1, and 200*c*2. For example, it is possible to form a single bypass part or two bypass parts in each sensor wiring substrate. Additionally, it is possible to form a plurality of bypass parts at distinct positions in the extending direction S. In short, each sensor wiring substrate may include at least one bypass part which is bent in a different direction from the extending direction S so as to bypass a certain area on the path between the couplers 300 and the connector 400.

(5) Fifth Variation

The foregoing embodiment and variations are each designed to include a single flexible board 200; but the present invention is not necessarily limited to sensor wiring substrates each including a single flexible board.

Figure 9:
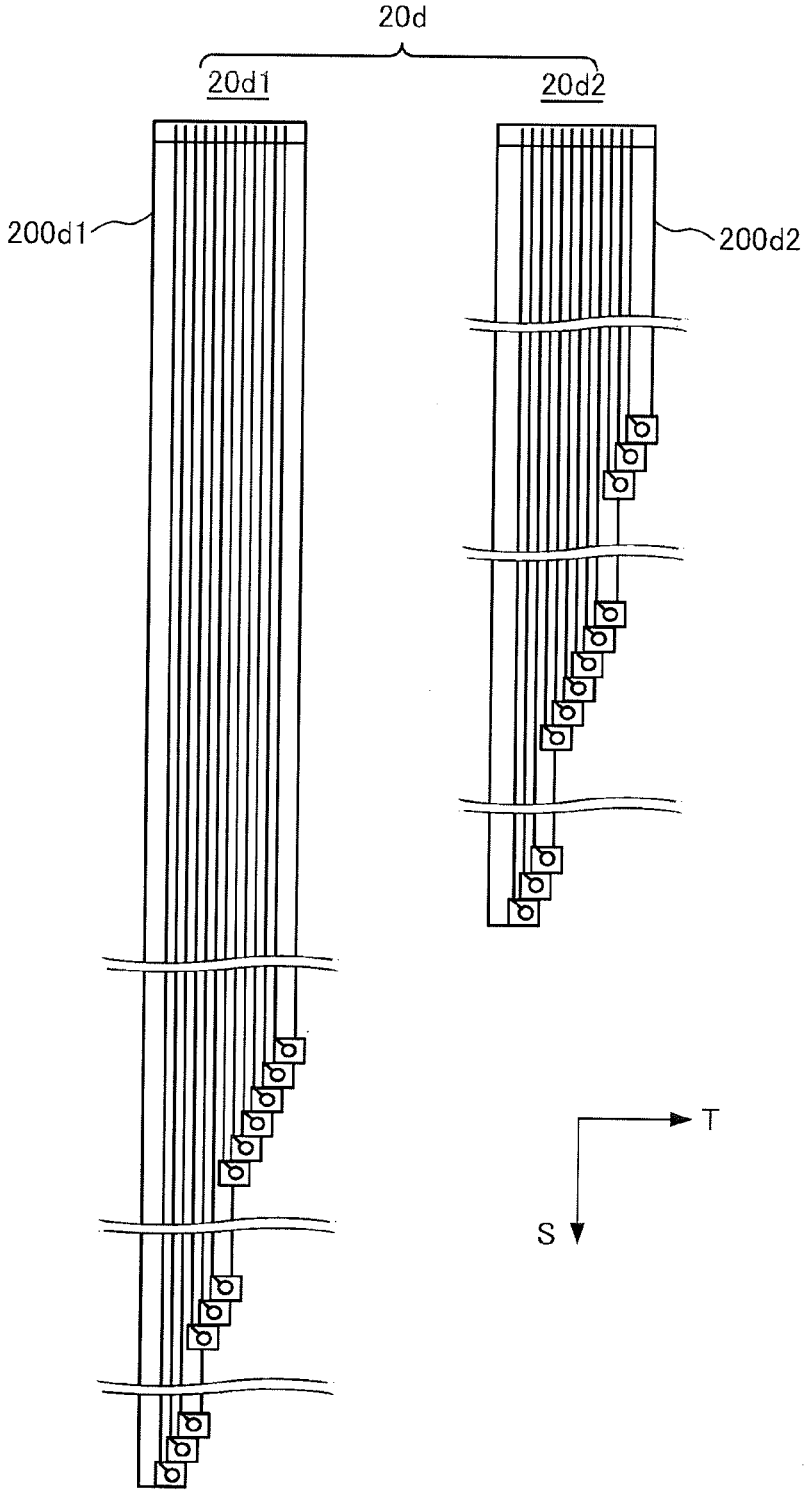
FIG. 9 is a schematic illustration of a sensor wiring substrate including two wiring sections with two flexible boards according to a fifth variation.

FIG. 9 is a schematic illustration of a sensor wiring substrate 20*d* including two wiring sections 20*d*1, 20*d*2 having flexible boards 200*d*1, 200*d*2 according to a fifth variation. The wiring sections 20*d*1, 20*d*2 of the sensor wiring substrate 20*d* are equivalent to the foregoing sensor wiring substrate 20 which is divided into two sections in the width direction T; hence, each of the wiring sections 20*d*1, 20*d*2 includes twelve wires and twelve couplers. The sensor wiring substrate 20*d* is attached to the shaft 12 of the golf club 10 such that the wiring sections 20*d*1, 20*d*2 are each positioned close to sensors which are connected to their couplers.

Figure 10:
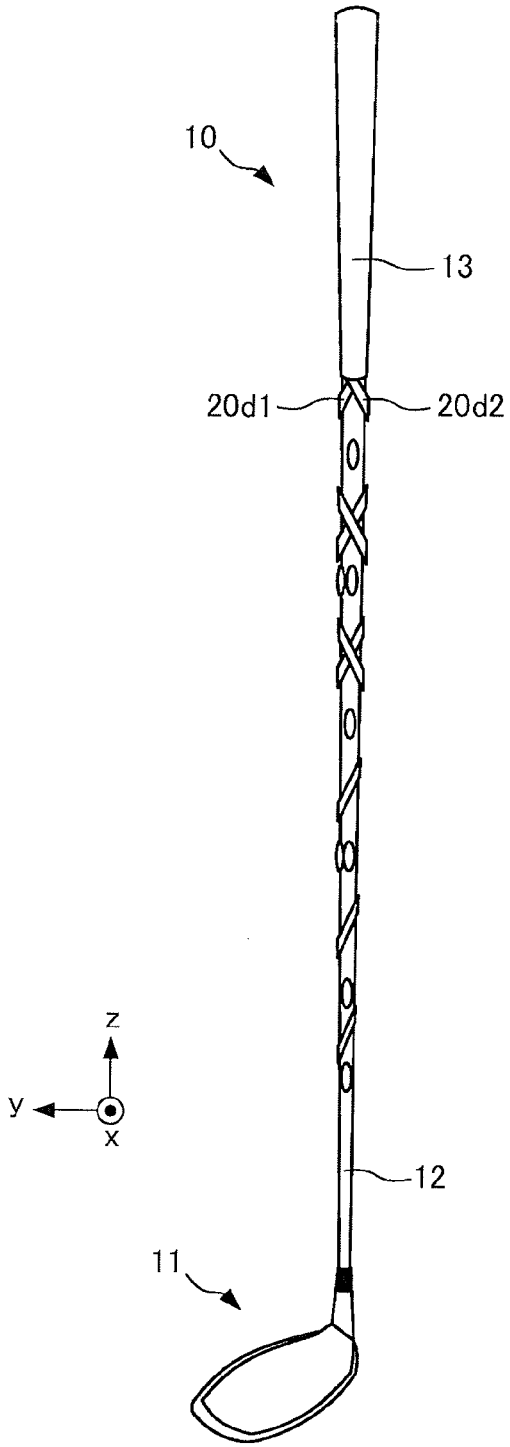
FIG. 10 is a perspective view of a golf club whose shaft is equipped with the wiring sections of the sensor wiring substrate which are helically wound in different directions.

FIG. 10 is a perspective view of the golf club 10 equipped with the sensor wiring substrate 20*d*. The wiring section 20*d*1 is helically wound about the shaft 12 ranging from the grip 13 to the head 11 such that it is wound in a clockwise direction in plan view. The wiring section 20*d*2 is helically wound about the shaft 12 ranging from the grip 13 to the head 11 such that it is wound in a counterclockwise direction in plan view. For this reason, the wiring section 20*d*2 partially overlaps with the wiring section 20*d*1.

As described above, when the sensor wiring substrate 20 is helically wound about the shaft 12 of the golf club 10, the warping of the shaft 12 or the golfer touching the shaft 12 may lead to occurrence of external force for bending the sensor wiring substrate 20 in the width direction Tin FIG. 1, wherein the magnitude of the external force depends on the width of the sensor wiring substrate 20. The sensor wiring substrate 20 having a small width is hardly damaged because the flexible board 200 having a small width may be easily deformed under a relatively low external force applied thereto, whilst the sensor wiring substrate 20 having a large width is easily damaged because the flexible board 200 may be hardly deformed until a relatively high external force is applied thereto. Compared to the sensor wiring substrate 20 having a single flexible board 200, the sensor wiring substrate 20*d* of the fifth variation is able to reduce a chance of being damaged due to external force exerted in the width direction T.

(6) Sixth Variation

In the foregoing embodiment, the intermediate portion of the sensor wiring substrate 20, precluding the connector 400 and the terminal end, is not fixed to the shaft 12 of the golf club 10; but the intermediate portion can be fixed to the shaft 12 of the golf club 10. In this case, a part of the intermediate portion of the sensor wiring substrate 20 can be fixed to the shaft 12, or the intermediate portion of the sensor wiring substrate 20 can be entirely fixed to the shaft 12. The sensor wiring substrate 20 with a large area fixed to the shaft 12 hardly forms gaps between the interior of the sensor wiring substrate 20 and the exterior of the shaft 12, thus reducing air resistance which may occur while the golf club 10 is being swung.

(7) Seventh Variation

The foregoing embodiment adopts a fixing method in which the sensor wiring substrate 20 is helically wound about the shaft 12 of the golf club 10; but the present invention is not necessarily limited this fixing method. For example, it is possible to present a sensor wiring substrate having a straight shape which can be straightly fixed along the shaft 12 (in the z-axis direction).

Figure 11:
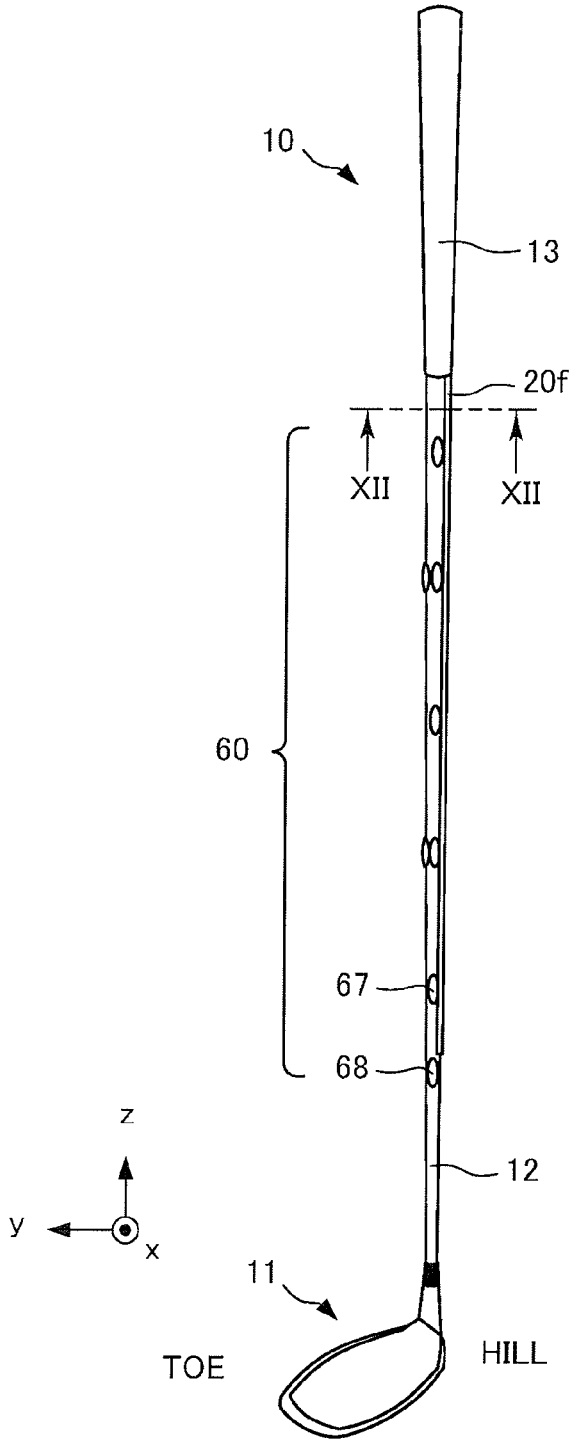
FIG. 11 is a perspective view of a golf club whose shaft is equipped with a sensor wiring substrate having a straight shape according to a seventh variation.

FIG. 11 is a perspective view of the golf club 10 equipped with a sensor wring substrate 20*f* having a straight shape according to a seventh variation. FIG. 11 is similar to FIG. 4 in terms of the number of sensors 60 and the positions of sensors 60 attached to the shaft 12 of the golf club 10. The sensor wiring substrate 20*f* is straightly attached to the shaft 12 ranging from the grip 13 to the head 11 in the z-axis direction such that the lower end of the sensor wiring substrate 20*f* is extended towards the sensors 67 and 68. The upper end of the sensor wiring substrate 20*f* is fixed and tightly held between the grip 13 and the shaft 12, whilst the remaining portion of the sensor wiring substrate 20*f* is attached to the shaft 12 by use of the adhesive agent or the adhesive tape. Additionally, the sensor wiring substrate 20*f* is attached to one side of the shaft 12, corresponding to the side of the heel, in the y-axis direction so that the sensor wiring substrate 20*f* will not overlap with the sensors 60. In this connection, the sensor wiring substrate 20*f* can be attached to another side of the shaft 12, opposite to the face 111 of the head 11, in the x-axis direction so that the sensor wiring substrate 20*f* will not overlap with the sensors 60. The method how to attach the sensor wiring substrate 20*f* to the shaft 12 will be described with reference to FIG. 12.

Figure 12:
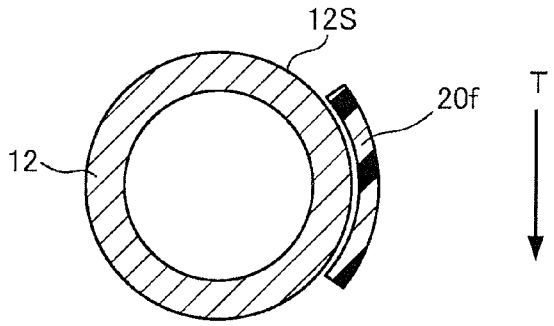
FIG. 12 is a cross-sectional view illustrating the fixation of the sensor wiring substrate slightly warped and attached to the curved surface of the shaft 12.

FIG. 12 is a cross-sectional view taken along line XII-XII in FIG. 11, illustrating the fixed manner of the sensor wiring substrate 20*f* attached to the shaft 12. The sensor wiring substrate 20*f* is attached to a curved surface 12S of the shaft 12 such that the sensor wiring substrate 20*f* is slightly warped in the width direction T. In either case where the sensor wiring substrate 20 is helically wound about the shaft 12 or where the sensor wiring substrate 20*f* is straightly attached to the shaft 12, each of the sensor wiring substrates 20 and 20*f* each including a flexible substrate can be slightly warped along the curved surface 12S of the shaft 12. Compared with another type of a sensor wiring substrate having no deformability along the curved surface 12S of the shaft 12, the sensor wiring substrate 20*f* having deformability along the curved surface 12S of the shaft 12 is able to reduce undulations which may be formed due to the straight wiring along the shaft 12, thus reducing air resistance caused by the shaft 12 while the golf club 10 is being swung. In short, the seventh variation is able to suppress unwanted variation of the behavior of the shaft 12 of the golf club 10 being swung due to the increasing air resistance.

(8) Eighth Variation

In the foregoing embodiment, the sensor wiring substrate 20 includes the flexible board 200 composed of polyethylene terephthalate material; but this is not a restriction. That is, it is possible to produce the flexible board 200 of the sensor wiring substrate 20 by use of other materials. For example, it is possible to produce the flexible board 200 by use of polyimide material. In this sense, it is possible to employ any other materials applicable to flexible boards which can be slightly warped and attached to the curved surface of the shaft 12. It is preferable that flexible boards be formed using materials with small weights in order to reduce negative influence to the behavior and the swinging motion of the shaft 12. Additionally, it is preferable to use materials having a certain degree of transparency allowing golfers to visually recognize damaged or broken wires included in sensor wiring substrates.

(9) Ninth Variation

Figure 13:
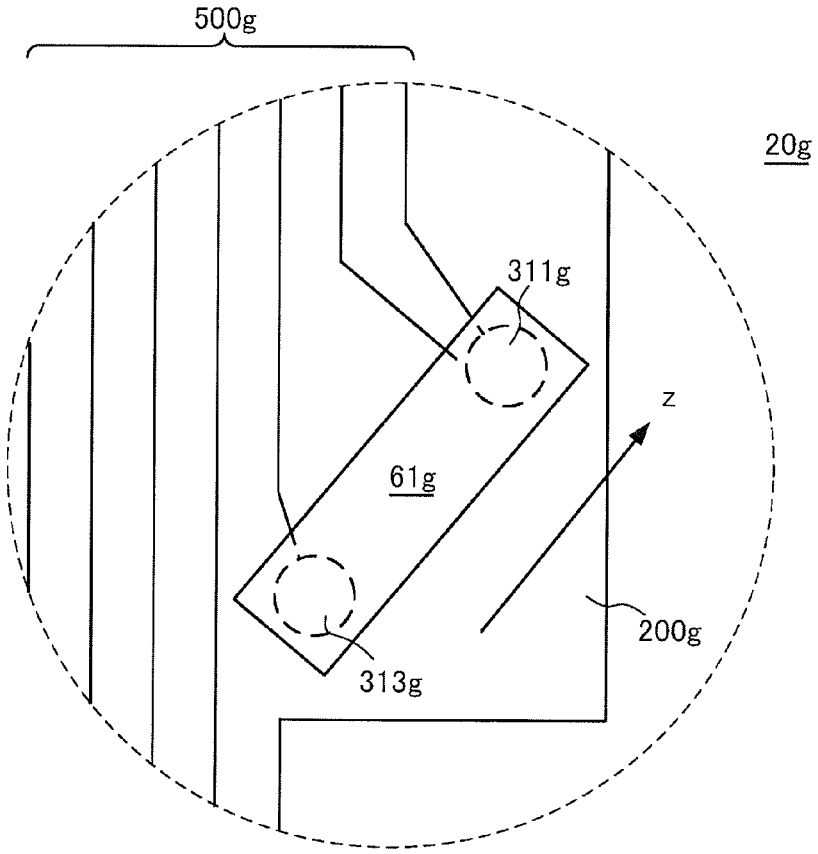
FIG. 13 is an enlarged view illustrating a part of a sensor wiring substrate directly equipped with a sensor according to a ninth variation.

In the foregoing embodiment, the sensors 60 are connected to the couplers 300 of the sensor wiring substrate 20; but this is not a restriction. That is, sensors can be directly attached to a flexible board of a sensor wiring substrate. FIG. 13 is an enlarged view illustrating a part of a sensor wiring substrate 20*g* directly equipped with a sensor 61*g* according to a ninth variation. The sensor wiring substrate 20*g* includes a flexible board 200*g*, a plurality of wires 500*g* (embedded in the flexible board 200*g*), and a plurality of couplers 310*g* (i.e. couplers 311*g* and 313*g*). The sensor 61*g* is connected to the couplers 310*g* via anisotropic conductive material such as an anisotropic conductive film at the predetermined position of the flexible board 200*g*. The surface of the sensor 61*g*, opposite to its backside connected to the couplers 310*g*, is exposed on the flexible board 200*g*. The exposed surface of the sensor 61*g* is brought into contact with the exterior of the shaft 12 when the sensor wiring substrate 20*g* is attached to the shaft 12. Additionally, the sensor wiring substrate 20*g* is attached to the shaft 12 of the golf club 10 such that the measuring direction of the sensor 61*g* matches with the direction for measuring strain values, e.g. the z-axis direction. The sensor wiring substrate 20*g* includes other couplers 310*g* which are connected to the other sensors (not shown) on the flexible board 200*g*. These sensors are automatically fixed to the predetermined positions along the shaft 12 when the sensor wiring substrate 20*g* is attached to the shaft 12, whereby they cooperate with the strain measuring device 40 to measure strain values occurring on the shaft 12 of the golf club 10 being swung. The ninth variation is advantageous in that the sensor wiring substrate 20*g* does not need to independently fix the sensors at the predetermined positions on the shaft 12 and does not need to adjust the fixed positions of the sensors. Compared to the foregoing embodiment in which the sensor wiring substrate 20 should be attached to the shaft 12 independently of the sensors 60 which are attached to the predetermined positions of the shaft 12, the sensor wiring substrate 20*g* of the ninth variation can be easily attached to the shaft 12 of the golf club 10 with a relatively small workforce.

(10) Tenth Variation

In the foregoing embodiment, the sensor wiring substrate 20 employs the flexible board 200 whose length is 1,200 mm in the extending direction S; but this is not a restriction. It is possible to employ the flexible board 200 with an appropriate length allowing the sensors 60 to be connected to the strain measuring device 40.

(11) Eleventh Variation

In the foregoing embodiment, the flexible board 200 is composed of polyethylene terephthalate material which is seamlessly elongated in the extending direction S; but this is not a restriction. Alternatively, it is possible to combine a plurality of boards which are aligned in the extending direction S. For example, three boards each having a 400 mm length in a wire-stretching direction are longitudinally combined to form a flexible board having a 1,200 mm length. In this case, the joints formed between three boards may be varied in rigidity compared to the rigidity of each board. For this reason, it is preferable that the joints between three boards be linearly aligned in the z-axis direction when a sensor wiring substrate including a combined flexible board (consisting of three boards) is attached to the shaft 12 of the golf club 10. Even when the sensor wiring substrate is warped along the shaft 12, the sensor wiring substrate is not necessarily warped in the direction of the joints between three boards. This prevents the unwanted occurrence of torsion in the combined flexible board due to the difference between the warping of joints and the warping of boards.

(12) Twelfth Variation

In the foregoing embodiment, the wires 500 are composed of copper; but this is not a restriction. It is possible to employ other materials having electrical conductivity for use in the wires 500. For example, a flexible board composed of polyimide material is naturally colored amber if not painted, wherein an amber color makes it difficult for a golfer (or a user) to visually recognize the embedded wires through the flexible board. In this case, it is necessary to adopt countermeasures, wherein the flexible board is modified to transmit visible light therethrough and painted with another color; or the wires are colored differently from the color of the flexible board. In short, it is necessary to differentiate the coloring between the flexible board and the wires even though the flexible board is able to transmit visible light therethrough, thus allowing a golfer (or a user) to visually recognize the embedded wires through the flexible board.

(13) Thirteenth Variation

The foregoing embodiment is basically designed to attach the sensor wiring substrate 20 to the golf club 10 of a wood type; but it is possible to attach the sensor wiring substrate 20 to other types of golf clubs such as utility clubs and iron clubs. The sensor wiring substrate 20 is not necessarily applied to golf clubs; hence, the sensor wiring substrate 20 can be applied to any types of rod-like tools undergoing warping/bending and torsion, such as fishing rods, tennis rackets, and bars used in the pole jump.

(14) Fourteenth Variation

The foregoing embodiment arranges the strain measuring device 40 inside the hollow space of the shaft 12; but it is possible to attach the strain measuring device 40 to the exterior of the shaft 12 or the exterior of the grip 13. In this case, the sensor wiring substrate 20 and the strain measuring device 40 can be easily attached to the golf club 10 without temporarily removing and putting back the grip 13.

(15) Fifteenth Variation

In the foregoing embodiment, the strain measuring device 40 is designed to wirelessly transmit measured values to an external device; but this is not a restriction. It is possible to process measured values by way of another method. For example, it is possible to simply store measured values in a memory. In this case, the grip 13 is removed so as to take the strain measuring device 40 out of the shaft 12 after the strain measuring device 40 finishes measuring strain values occurring on the shaft 12 of the golf club 10 being swung; thereafter, the measured values stored in a memory are read out using a readout device or the like, thus allowing a golfer (or a user) to visually check the measured values.

(16) Sixteenth Variation

The present invention can be defined as a flexible board for use in a sensor wiring substrate, a golf club measuring system or a golf club using the flexible board. Additionally, the present invention can be defined as a method for measuring physical values such as strain values by use of the flexible board and the sensor wiring substrate.

Figure 14:
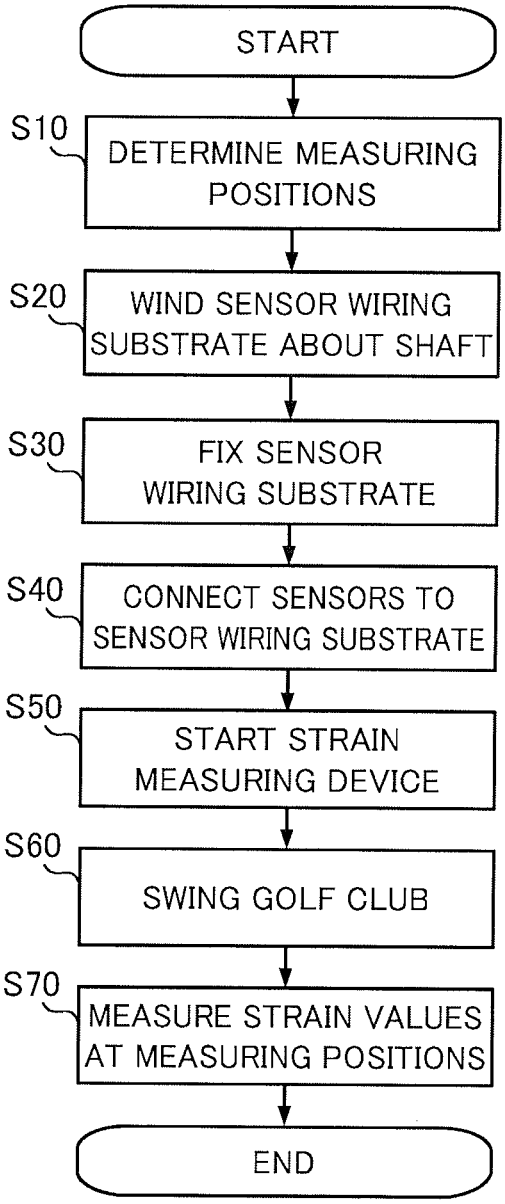
FIG. 14 is a flowchart relating to a strain measuring process using a sensor wiring substrate.

FIG. 14 is a flowchart relating to a strain measuring process using a sensor wiring substrate. This flowchart shows a series of steps in which a user of the golf club 10 is going to measure strain values by use of the sensor wiring substrate 20 attached to the shaft 12 of the golf club 10. First, the user determines the measuring positions for measuring strain values on the shaft 12 (step S10). The user helically winds the sensor wiring substrate 20 about the shaft 12 in conformity with the measuring positions (step S20). Specifically, the user winds the sensor wiring substrate 20 about the shaft 12 such that the couplers 300 are positioned close to the measuring positions. Subsequently, the user fixes the opposite ends of the sensor wiring substrate 20 to the predetermined positions of the shaft 12 (step S30). At this time, the user temporarily takes the grip 13 off from the shaft 12 so as to put the strain measuring device 40, coupled with the connector 400, into the hollow space inside the shaft 12. Subsequently, the user reattaches the grip 13 back to the shaft 12 while fixing the upper portion of the sensor wiring substrate 20 which is tightly held between the grip 13 and the shaft 12; then, the user fixes the opposite terminal end of the sensor wiring substrate 20 to the lower portion of the shaft 12 by use of an adhesive tape or the like. In this connection, it is possible to remove the grip 13 from the shaft 12 before step S10 or S20. Next, the user connects the sensors 60 to the couplers 300 of the sensor wiring substrate 20 by use of the connecting wires 610 (step S40). The sensors 60 can be attached to the shaft 12 in step S40. Alternatively, it is possible to attach the sensors 60 to the shaft 12 before step S40 and after step S10 in order to determine the measuring positions. Thus, it is possible to establish the foregoing condition of the golf club 10 equipped with the sensor wiring substrate 20 and the sensors 60 shown in FIG. 4.

Thus, the user operates an external device (not shown) to wirelessly instruct the strain measuring device 40 to start its operation (step S50). In this condition, the user holds the grip 13 of the golf club 10 and swings the golf club 10 (step S60). In step S60, the strain measuring device 40 receives signals representing strain values at the measuring positions from the sensors 60 attached to the shaft 12, thus measuring strain values based on the received signals (step S70).

Thereafter, the strain measuring device 40 produces and transmits the strain values to an external device, with which the user is able to refer to the strain values occurring on the shaft 12 of the golf club 10 being swung.

In the above, the flowchart is described such that the same user conducts each step of the strain measuring process; but this is not a restriction. A plurality of users may selectively conduct the foregoing steps of the flowchart. When three users are involved in the strain measuring process, for example, a first user conducts a series of steps S10 to S40 for attaching the sensor wiring substrate 20 and the sensors 60 to the shaft 12 of the golf club 10; a second user conducts step S60 for actually swinging the golf club 10; and a third user conducts steps S50 and S70 of measuring strain values.

(17) Seventeenth Variation

In the sensor wiring substrate 20 of the foregoing embodiment, the couplers 360 are attached the terminal end portion of the flexible board 200 opposite to the connector 400 and fixed to the lower end portion of the shaft 12; but this is not a restriction. For example, it is possible to additionally provide an extended portion, following the couplers 360, not equipped by any couplers and any wires, wherein the extended portion is fixed to the lower end portion of the shaft 12.

Figure 15:
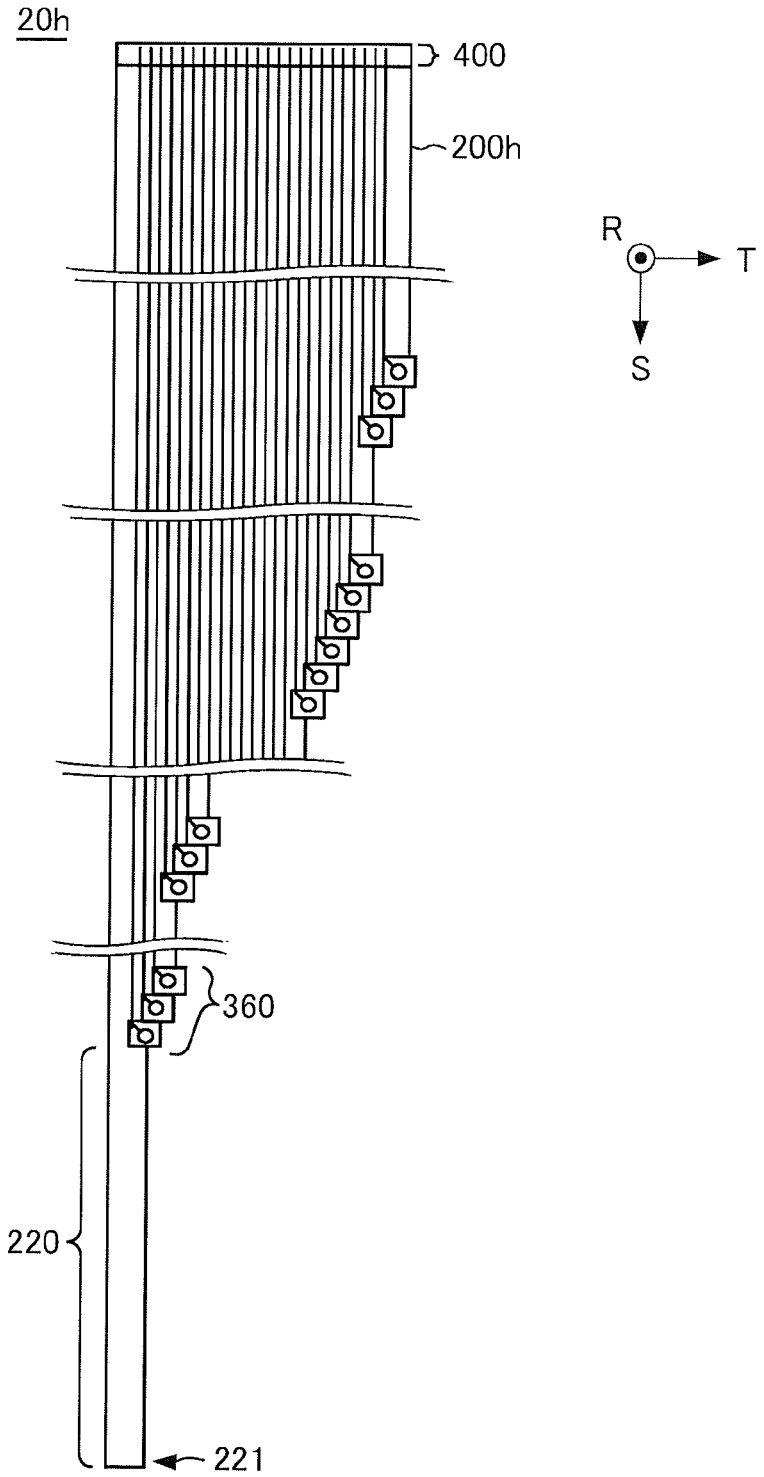
FIG. 15 is a schematic illustration of a sensor wiring substrate including an extended portion following lower-end couplers on a flexible board.

FIG. 15 is a schematic illustration of a sensor wiring substrate **20*h* according to a seventeenth variation. The sensor wiring substrate 20*h* includes a flexible board 200*h* with the couplers 360, the connectors 400, and an extended portion 220. The constitution of the sensor wiring substrate 20*h* ranging from the connector 400 to the couplers 360 is equivalent to the constitution of the sensor wiring substrate 20. The extended portion 220, constituting the lower end portion of the flexible board 200*h*, is extended below the couplers 360, which are the lowest couplers distanced from the connector 400, in the extending direction S. The extended portion 220 has a lower end 221 in the extended direction S, which is an opposite terminal end distanced from the connector 400 attached to the upper end of the flexible board 200*h***.

The sensor wiring substrate 20*h* can be easily attached to the golf club 10 such that the upper end of the flexible board 200*h* (close to the connector 400) and the lower end 221 of the extended portion 220 are fixed to the predetermined positions along the shaft 12. In this case, no wires and no couplers are connected to the lower end 221 of the extended portion 220 of the sensor wiring substrate 20*h* which is positioned close to the head 11 of the golf club 10, whereas the sensor wiring substrate 20*h* functions similar to the sensor wiring substrate 20 in that the sensor wiring substrate 20*h* includes the flexible board 200*h* which is slightly warped and attached to the curved surface of the shaft 12. Compared to the cable wiring, the sensor wiring substrate 20*h* is advantageous in that it is able to reduce air resistance which occurs during a swinging motion of the golf club 10. Additionally, the sensor wiring substrate 20*h* is able to demonstrate the same advantageous effects as those produced by the sensor wiring substrate 20 according to the foregoing embodiment and variations. In short, the sensor wiring substrate 20*h* presents good adhesion with the golf club 10 because it is very simple to fix the flexible board 200*h* with the shaft 12 such that the upper end thereof (close to the connector 400) and the lower end 221 of the extended portion 220 are simply fixed to the predetermined positions along the shaft 12. In this connection, it is possible to modify the sensor wiring substrate 20*h* having another extended portion which is extended from the upper end of the flexible board 200*h* (close to the connector 400) and which is not equipped with any wires and any couplers. This modification may be advantageous in that wires can be easily attached to the connector 400 after the upper extended portion of the sensor wiring substrate 20*h* is firmly fixed to the predetermined position of the shaft 12.

(18) Eighteenth Variation

In the foregoing embodiment, the golf club measuring system includes the sensor wiring substrate 20, the sensors 60, and the strain measuring device 40; but this is not a restriction. For example, it is possible to modify the golf club measuring system solely having the sensor wiring substrate 20 and the sensors 60. In this case, the user who uses the golf club measuring system attached to the shaft 12 of the golf club 10 needs to prepare an external device such as the strain measuring device 40, wherein the user should electrically connect the external device to the connector 400 of the sensor wiring substrate 20.

(19) Nineteenth Variation

In the foregoing embodiment and variations, the sensor wiring substrate 20 (similarly the sensor wiring substrates 20*d*, 20*f*, and 20*h*) is fixed to the shaft 12 with the upper end and the lower end thereof in the extended direction S; but this is not a restriction. That is, the flexible board 200 (similarly the flexible boards 200*d*, 200*f*, and 200*h*) can be fixed to the shaft 12 with the intermediate portion between the upper end and the lower end. In this case, a clearance portion is formed between the upper end of the sensor wiring substrate 20 (close to the grip 13) and the other portion of the sensor wiring substrate 20 attached to the shaft 12. The clearance portion allows the sensor wiring substrate 20 to be slightly separated from the exterior of the shaft 12. The clearance portion can be used as a flexible wiring portion, which allows other wires or an electronic device (e.g. the strain measuring device 40) to be installed therein outside the exterior of the shaft 12. Thus, the clearance portion eliminates the necessity of introducing a part of the sensor wiring substrate 20 into the hollow space inside the shaft 12. That is, it is possible to easily connect the sensor wiring substrate 20 with an electronic device or transmit signals to an external device via wires. Another clearance portion can be formed along the lower portion of the shaft 12 by not fixing the lower end of the sensor wiring substrate 20 to the lower end portion of the shaft 12 close to the head 11. This clearance portion close to the head 11 allows for installation of an acceleration sensor (not shown) whose signals are forwarded to the upper portion of the sensor wiring substrate 20 close to the grip 13. Additionally, these clearance portions may allow for installation of an LED, a microphone, or a speaker, each of which may provide auxiliary information for the purpose of high-accuracy measurement.

For example, it is possible to attach an LED (or LEDs) to the lower portion of the shaft 12 close to the head 11. This LED may serve as a marker picked up using a high-speed camera, which detects a series of pictures relating to a swinging motion of the golf club 10.

It is possible to attach a microphone to the lower portion of the shaft 12 close to the head 11. This microphone is able to efficiently detect a hitting sound representative of the hitting of a golf ball with the head 11 of the golf club 10. The hitting sound may contribute to assessment of the golf club 10 in terms of its golf-ball hitting behavior.

It is possible to attach a speaker to the lower portion of the shaft 12 close to the head 11. This speaker may generate a buzzer sound signaling a good/bad manner of a swinging motion of the golf club 10. Additionally, it is possible to carry out a golf training game using this speaker, allowing a player to check his/her swinging motion with the golf club 10. In this case, the speaker may generate sound effect during a swinging motion of the golf club 10.

3. Multipoint Measurement

In relation to step S70 of the flowchart shown in FIG. 14, the inventor has made rigorous analysis on the advantages of multipoint measurement compared to single-point measurement with regard to physical values such as rigidity and tortion.

Generally speaking, the same rigidity is not applied to the entire length of a golf club shaft from its upper portion (close to a grip) to the lower portion (close to a head), wherein the upper portion is soft in rigidity whilst the lower portion is hard in rigidity. Conventionally, golf club shafts possess a simple rigidity profile which can be subdivided into three sections along the entire length thereof. Due to the recent advancement of technology, however, golf club shafts possess a fragmentary rigidity profile which can be subdivided into four or five sections along the entire length thereof; hence, golf clubs have been diversified in rigidity. Conventionally, there is no option other than static characteristic testing (e.g. three-point bending testing) applicable to testing of golf club shafts; hence, there are needs of dynamic characteristic testing among manufacturers and dealers.

Figure 16A:
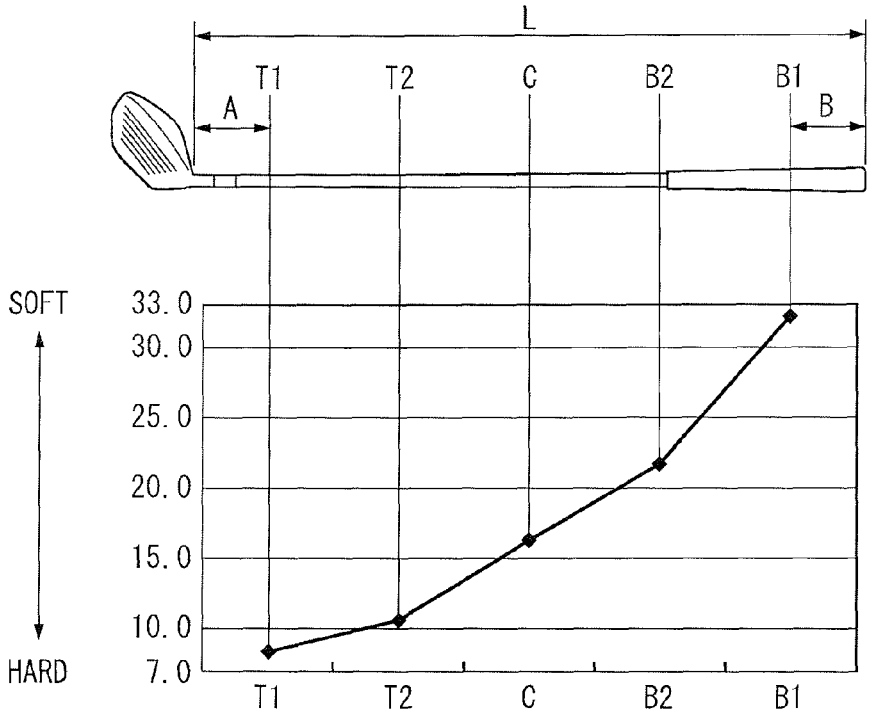
FIG. 16A shows a static characteristic measurement result regarding a rigidity profile on a golf club shaft at five measuring points.
Figure 16B:
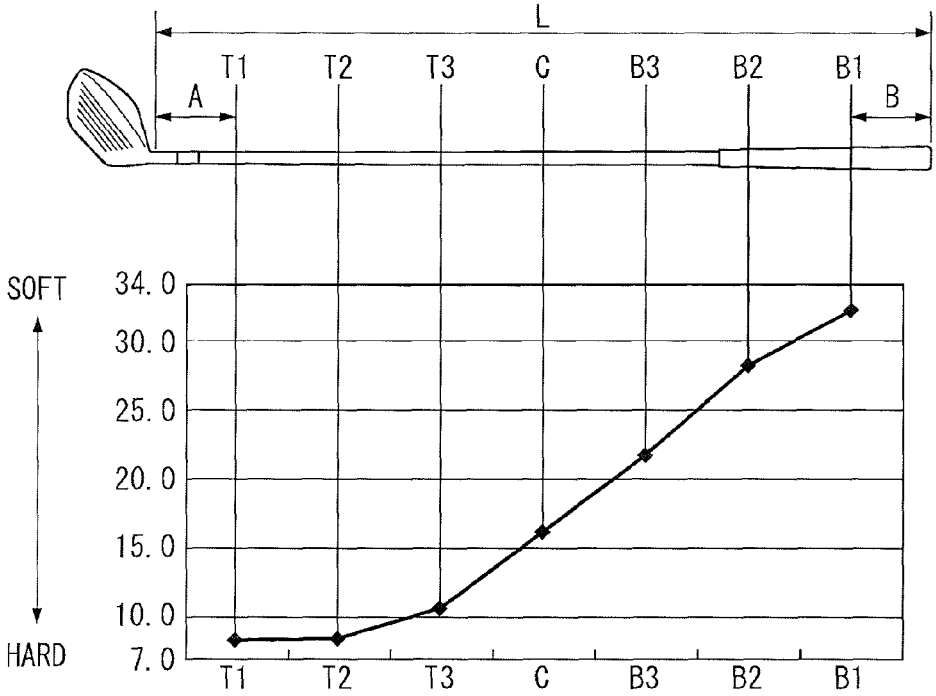
FIG. 16B shows a static characteristic measurement result regarding a rigidity profile on a golf club shaft at seven measuring points.

FIGS. 16A and 16B show examples of static characteristic measurement results on golf clubs. FIG. 16A shows a golf club having a length L, a lower portion A, and an upper portion B, with which five measuring points T1, T2, C, B2, B1 (where C denotes a midpoint; T1, T2 are aligned in the tip side while B1, B2 are aligned in the base side of a golf club shaft) are set to measure rigidity values. A graph of FIG. 16A shows a line graph connecting rigidity values measured at five measuring points. FIG. 16B shows a golf club having a length L, a lower portion A, and an upper portion B, with which seven measuring points T1, T2, T3, C, B3, B2, B1 (where C denotes a midpoint; T1-T3 are aligned in the tip side while B1-B3 are aligned in the base side of a golf club shaft) are set to measure rigidity values. A graph of FIG. 16B shows a line graph connecting rigidity values measured at seven measuring points. The static characteristic measurement basically depends on the number of measuring points; hence, the static characteristic measurement using a small number of measuring points does not necessarily match with an actual rigidity profile of a gold club shaft. In short, multipoint measurement is essential to accurately measure physical values of a golf club shaft during its swinging motion.

Figure 17:
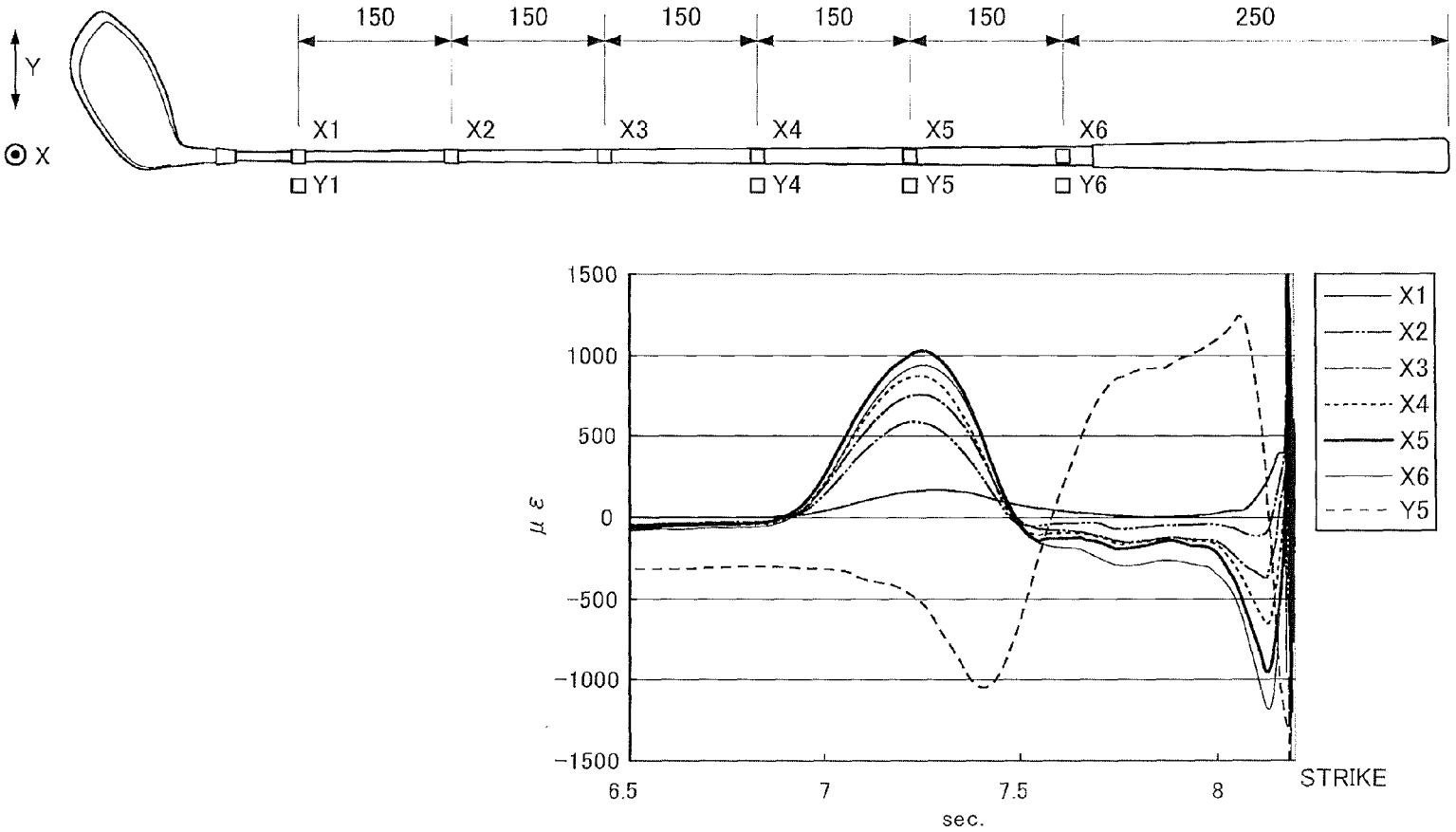
FIG. 17 shows a dynamic characteristic measurement result regarding a torsion profile on a golf club shaft at multiple measuring points.

FIG. 17 shows a dynamic characteristic measurement result regarding a torsion profile on a golf club at multiple measuring points. FIG. 17 shows a golf club shaft equipped with six x-axis sensors X1 to X6 and four y-axis sensors Y1, Y4-Y6, wherein the suffix numbers 1-6 following symbols X and Y indicate the six positions which are set along a golf club shaft (precluding the top portion of 250 mm) with equal spacing of 150 mm therebetween. Herein, it is possible to additionally arrange y-axis sensors Y2 and Y3 in correspondence with the x-axis sensors X2 and X3; but the y-axis sensors Y2, Y3 can be omitted because the y-axis sensors Y5, Y6 yields significant values in measurement. With these sensors attached to a golf club shaft at the predetermined positions, it is possible to achieve highly accurate multipoint measurement regarding dynamic characteristics of a golf club shaft such as a torsion profile occurring in a swinging motion of a golf club.

A graph of FIG. 17 shows characteristic curves representing measured values of torsion with the x-axis sensors X1 to X6 and the y-axis sensor Y5 with respect to torsion profiles at seven measuring points two seconds prior to the striking of a golf ball with a golf club head. These measured values are useful in assessment of each golf club shaft.

Lastly, the present invention is not necessarily limited to the foregoing embodiment and variations, which can be further modified in various ways within the scope of the invention as defined in the appended claims.

What is claimed is:

1. A golf club measuring system for dynamically measuring physical qualities of a golf club shaft as it is being swung, comprising:

a sensor wiring substrate in the form of a flexible ribbon that can be helically wound externally about a predetermined length of the shaft, the sensor wiring substrate having a plurality of wires embedded therein;

a plurality of sensors, each sensor being electrically coupled to a respective set of the wires and sensing the physical qualities of the shaft as it is swung; and a storage device electrically coupled to the wires and receiving and storing information about the output of the plurality of sensors when the sensors are placed at respective positions on the shaft and the shaft is swung so as to allow a determination of the physical qualities of the shaft to be determined based upon the stored information.

2. The golf club measuring system of claim 1, wherein the sensors are strain sensors and the storage device stores information about the strain on the golf club shaft as the golf club is swung.

3. The golf club measuring system of claim 1, wherein the storage device wirelessly transmits the stored information to an external device.

4. The golf club measuring system of claim 1, further including a plurality of couplers, each coupler coupling a respective sensor to a respective set of the wires.

5. The golf club measuring system of claim 1, wherein the sensor wiring substrate is coupled to the strain measuring device at one end and coupled to the sensors at different locations along the length of the sensor wiring substrate and the width of the sensor wiring substrate is largest at the one end and tapers along its length.

6. The golf club measuring system according to claim 5, further including a coupler located at the one end which electrically connects the wires to the strain measuring device.

7. The golf club measuring system according to claim 1, wherein in the sensor wiring substrate extends along an axis and includes one or more curved portions which extend away from the axis and allow at least one of the sensors to be located along the axis of the sensor wiring substrate.

8. The golf club measuring device according to claim 1, wherein the sensor wiring substrate is formed of a translucent material which has a color which is different than the color of the wires.

9. A golf club shaft having a strain measuring system for dynamically physical qualities of the shaft at multiple locations on the shaft as the shaft is swung, comprising:

a golf club shaft;

a sensor wiring substrate in the form of a flexible ribbon helically wound externally about a predetermined length of the shaft, the sensor wiring substrate having a plurality of wires embedded therein;

a plurality of sensors, each sensor being electrically coupled to a respective set of the wires and being located at a respective position on the shaft; and a storing device electrically coupled to the wires and receiving electrical signals from the plurality of sensors so as to allow the physical qualities of the shaft to be determined based upon the stored information.

10. The golf club shaft claim 9, wherein the sensors are strain sensors and the storage device stores information about the strain on the golf club shaft as the golf club is swung.

11. The golf club shaft of claim 9, wherein the wires are juxtaposed to one another.

12. The golf club shaft of claim 9, wherein the wired are printed wires.

13. The golf club shaft of claim 9, further including a plurality of couplers, each coupler coupling a respective sensor to a respective set of the wires.

14. The golf club shaft of claim 9, wherein the width of the sensor wiring substrate is tapered along its length.

15. The golf club shaft of claim 14, wherein the sensor wiring substrate is coupled to the strain measuring device at one end and coupled to the sensors at different locations along the length of the sensor wiring substrate and the width of the sensor wiring substrate is largest at the one end and tapers along its length.

16. The golf club shaft according to claim 15, further including a coupler located at the one end which electrically connects the wires to the strain measuring device.

17. The golf club shaft according to claim 9, wherein in the sensor wiring substrate extends along an axis and includes one or more curved portions which extend away from the axis and allow at least one of the sensors to be located along the axis of the sensor wiring substrate.

18. The golf club shaft according to claim 17, wherein the one or more curved portions include an s-shaped portion.

19. The golf club shaft according to claim 17, wherein the one or more curved portions include an oval-shaped portion.

20. The golf club shaft according to claim 9, wherein the sensor wiring substrate is formed of a translucent material which has a color which is different than the color of the wires.

* * * * *